US006196911B1

(12) United States Patent
Preston et al.

(10) Patent No.: US 6,196,911 B1
(45) Date of Patent: Mar. 6, 2001

(54) TOOLS WITH ABRASIVE SEGMENTS

(75) Inventors: Jay B. Preston, Woodbury, MN (US); Naum N. Tselesin, Atlanta, GA (US); Ian Gorsuch, Biddenden (GB)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 08/984,899

(22) Filed: Dec. 4, 1997

(51) Int. Cl.[7] ..... B24D 7/00

(52) U.S. Cl. ..... 451/548; 451/527; 451/550; 451/529

(58) Field of Search ..... 451/548, 527, 451/529, 530, 550, 551

(56) References Cited

U.S. PATENT DOCUMENTS

| | | | | |
|---|---|---|---|---|
| 976,689 | * | 11/1910 | Pollard | 451/551 |
| 1,622,942 | * | 3/1927 | Chase | 451/551 |
| 1,670,780 | * | 5/1928 | Mills | 451/551 |
| 2,194,546 | | 3/1940 | Goddu et al. . | |
| 2,409,363 | | 10/1946 | Kratky . | |
| 2,883,807 | * | 4/1959 | Titcomb | 451/548 |
| 3,043,064 | * | 7/1962 | Peterson | 451/529 |
| 3,120,724 | * | 2/1964 | Mockiewicz et al. | 451/529 |
| 3,250,045 | * | 5/1966 | Caserta | 451/548 |
| 4,131,436 | | 12/1978 | Wiand . | |
| 4,925,457 | | 5/1990 | deKok et al. . | |
| 5,028,177 | * | 7/1991 | Meskin et al. | 451/145 |
| 5,049,165 | | 9/1991 | Tselesin . | |
| 5,092,910 | | 3/1992 | deKok et al. . | |
| 5,190,568 | | 3/1993 | Tselesin . | |
| 5,197,249 | * | 3/1993 | Wiand | 451/529 |
| 5,203,880 | | 4/1993 | Tselesin . | |
| 5,243,790 | * | 9/1993 | Gagne | 451/529 |
| 5,380,390 | | 1/1995 | Tselesin . | |
| 5,385,591 | | 1/1995 | Ramanath et al. . | |
| 5,489,235 | | 2/1996 | Gagliardi et al. . | |
| 5,496,206 | | 3/1996 | Young . | |
| 5,518,443 | | 5/1996 | Fisher . | |
| 5,567,503 | * | 10/1996 | Sexton et al. | 451/527 |
| 5,620,489 | | 4/1997 | Tselesin . | |
| 5,656,045 | | 8/1997 | Wiand . | |
| 5,820,450 | * | 10/1998 | Calhoun | 451/527 |
| 6,017,265 | * | 1/2000 | Cook et al. | 451/41 |
| B1 4,925,457 | | 9/1995 | deKok et al. . | |
| B1 5,049,165 | | 9/1995 | Tselesin . | |
| B1 5,092,910 | | 9/1995 | deKok et al. . | |
| B1 5,190,568 | | 3/1996 | Tselesin . | |
| B1 5,203,880 | | 10/1995 | Tselesin . | |
| B1 5,380,390 | | 10/1996 | Tselesin . | |

FOREIGN PATENT DOCUMENTS

| | | |
|---|---|---|
| 0 547 012 A2 | 6/1993 | (EP) . |
| 3-161278 | 7/1991 | (JP) . |
| 3-190673 | 8/1991 | (JP) . |
| 9-19869 | 1/1997 | (JP) . |
| WO 89/01843 | 3/1989 | (WO) . |

OTHER PUBLICATIONS

3M Flexible Diamond Products for Industrial Markets, Feb. 10, 1997, PL–159—Marketing literature.

* cited by examiner

*Primary Examiner*—David A. Scherbel
*Assistant Examiner*—Lee Wilson
(74) *Attorney, Agent, or Firm*—Scott R. Pribnow

(57) ABSTRACT

A tool including abrasive segments, which can be superabrasive segment, mounted to a mounting plate and a method for making the same. The abrasive segments include hard particles and are formed by sintering layers of hard particles with layers of bond material to form a laminated sheet. The abrasive segments are then cut from the laminated sheet and mounted to a planar face of the mounting plate to form a portion of a working region of the tool. Each segment has a grinding surface which can be formed perpendicular to the layers of bond material and layers of hard particles so that the concentration of hard particles at the grinding surface is relatively high. This allows the portion of working surface made up of the abrasive segments to relatively small. The segments can also be mounted to the substrate disc such that the grinding surface of each segment is at an angle to the planar face.

28 Claims, 19 Drawing Sheets

TOOLS WITH ABRASIVE SEGMENTS

BACKGROUND OF THE INVENTION

1. Field of the Invention

The present invention relates generally to cutting and grinding abrasive tools. In particular the present invention relates to a grinding tool such as a disc or wheel or brick having abrasive segments, preferably superabrasive segments, affixed thereto and a method for making the same.

2. Description of the Related Art

Certain types of workpieces (plastic and glass lenses, stone, concrete, and ceramic for example) can be advantageously shaped using grinding tools, such as a wheel or disc, which have an abrasive work surface, particularly a superabrasive work surface, a superabrasive surface also being an abrasive surface but having a higher abrasivity. Many other substances can also benefit from this type of shaping or grinding by a superabrasive work surface. The work surface of the grinding wheel is commonly made up of one or both planar disc surfaces on each face of the grinding wheel. The work surface usually includes particles of super hard or abrasive material, such as diamond, cubic boron nitride, or boron suboxide surrounded by a bond material and/or embedded in a metal matrix. It is these hard particles that primarily act to cut or grind a workpiece as it is brought into contact with a rotating work surface of the grinding tool.

Grinding wheels and discs including a work surface having a homogeneous concentration of hard particles over the entire work surface are known in the art. Also known are grinding wheels and discs including work surfaces having regions of higher concentrations of hard particles, regions of lower concentrations of hard particles, and regions having no hard particles.

Because grinding characteristics of a grinding tool, e.g. disc or wheel, such as grinding rate and tool wear rate can be varied by varying the area of grinding surface (the surface of the tool which acts primarily to grind a workpiece) on the grinding tool, it is advantageous to be able to vary the area of grinding surface on a grinding tool. However, the grinding tools discussed above are formed such that the grinding surfaces have a moderate concentration of hard particles. As such, relatively large areas of the work surface of the tools must make up the grinding surface and precise, variation of the area of the grinding surface of the tool can be problematic. Further, the cost of fabricating a grinding tool having a relatively large area of the work surface made up of grinding surface can be relatively high.

Accordingly, there is a continuing need for improved grinding tools. In particular, there is a need to be able to vary the area of the grinding surface of a grinding tool to allow the tool to be able to achieve relatively high grinding speeds while retaining a relatively long life. Also, there is a need to be able to reduce the portion of a work surface of a grinding tool which has abrasive particles so that the tool can be efficiently manufactured.

SUMMARY OF THE INVENTION

The present invention includes a machine tool, such as a grinding or cutting tool, for connection to a tool driver for moving the tool relative to a workpiece, preferably in a rotary motion. The rotary motion can be either about an axis within the tool or about an axis external to the tool. Other motions in which the tool driver can move the tool relative to the workpiece include a reciprocating and/or an oscillating motion either with or without the rotary motion. The tool comprises a mounting plate and at least one, preferably a plurality of abrasive segments, which can preferably be superabrasive segments, mounted to a first surface of the mounting plate. The abrasive segments are made up of a plurality of layers and has a face defined by a general plane of one of the layers. Each segment is attached to the mounting plate such that its face forms an angle of between 0 degrees and 180 degrees, exclusive, with the mounting plate.

A method of fabricating the tool includes forming an assembly that may comprise a laminated sheet having a plurality of thickness layers. In one embodiment, each thickness layer includes at least a layer of bond or filler material and a layer of abrasive or hard particles, preferably superabrasive particles. The laminated assembly is sintered to form the laminated sheet from which the abrasive segments are cut. The segments are then attached to a mounting plate such that the grinding surface of at least one segment is at an angle to the plurality of thickness layers and preferably normal thereto. This allows the concentration of hard particles at each grinding surface to be relatively high.

It should be understood that, herein, both cutting and grinding indicate removal of material from the workpiece by hard particles retained by and protruding from an abrasive segment. In this sense, there is no difference between cutting and grinding operations.

DETAILED DESCRIPTION OF THE PREFERRED EMBODIMENTS

Figure 1:
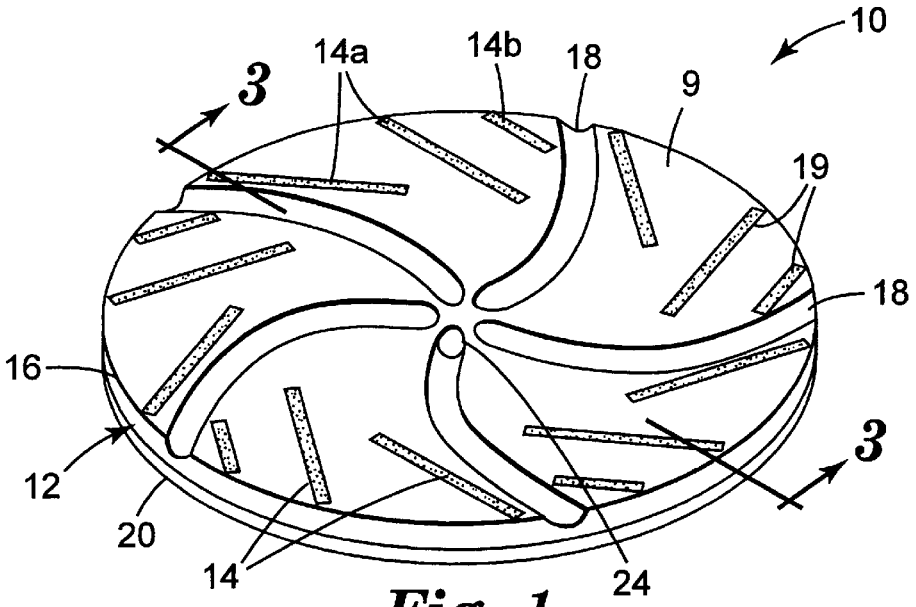
FIG. 1 is a perspective view of a grinding tool including a plurality of abrasive segments mounted on a rotatable disc in accordance with the present invention.
Figure 2:
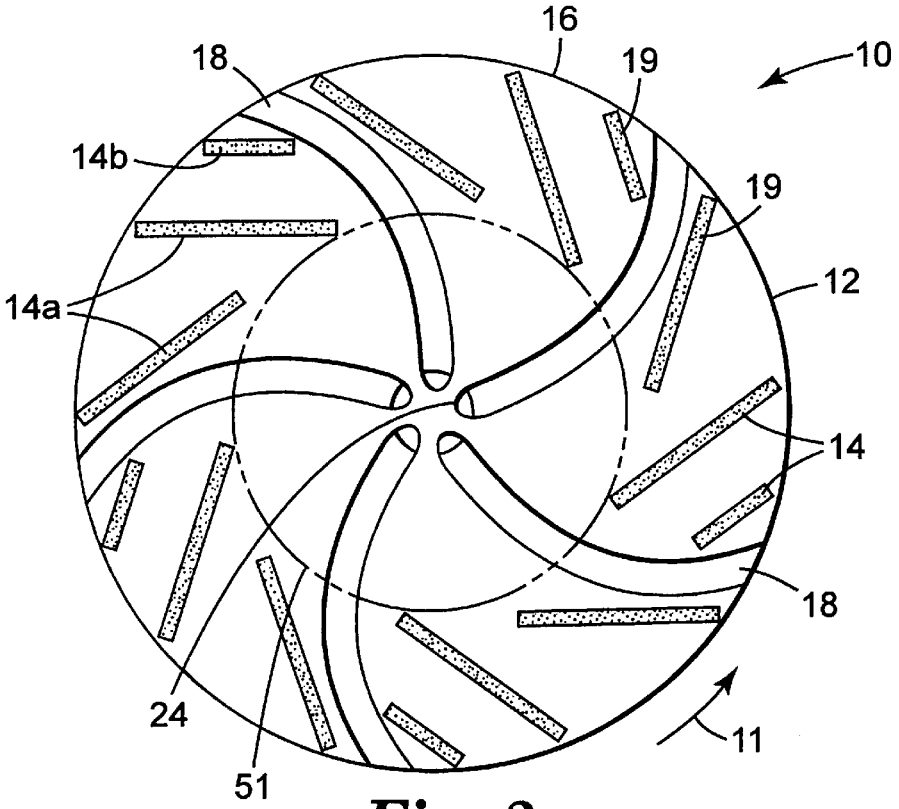
FIG. 2 is a top view of the grinding tool shown in FIG. 1.

A tool 10 having abrasive segments 14 including abrasive particles in accordance with the present invention is shown in a perspective view in FIG. 1 and a top view in FIG. 2. Abrasive segments 14 have grinding surfaces 19, which are the surfaces of segments 14 which primarily act to abrade a work object (not shown). Tool 10 is designed to be moved in a periodic motion, specifically, a circular or rotary motion. Tool 10 includes a working region that is defined by the area swept out by paths of each grinding surface of the plurality of abrasive segments as the grinding tool is moved through a single rotation of its rotary motion. Working region 12 of tool 10 includes elements or segments 14 surrounded by filler material 16. Segments 14 can also be superabrasive.

Figure 3:
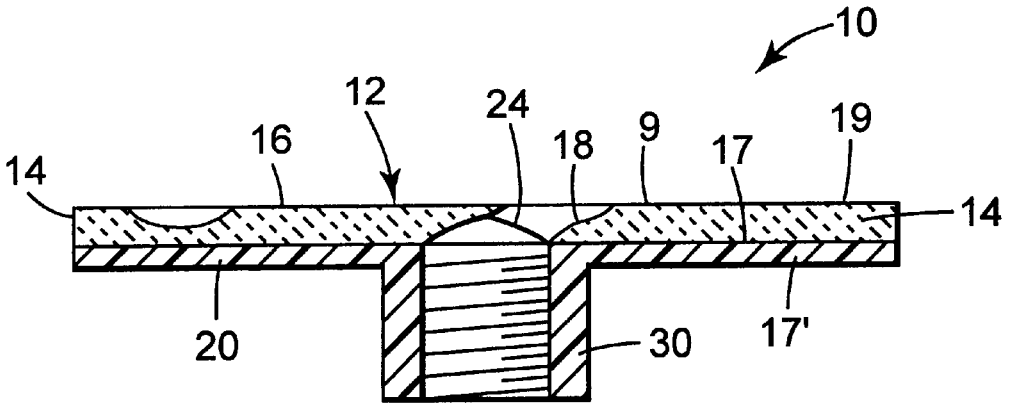
FIG. 3 is a sectional view of the grinding tool shown in FIG. 1 taken along section line 3—3 of FIG. 1.

Segments 14 are mounted to a first substantially planar face 17 of a mounting plate in the form of a substrate disc 20, shown in FIG. 3 which is a sectional view of tool 10 taken along line 3—3 of FIG. 1. In the embodiment shown in FIGS. 1, 2, and 3, working region 12 is the annular region between the circle 51, defined by the inner most tips of the longest elements 14*a*, and the perimeter of substrate disc 20. However, other shapes for working region 12 and substrate disc 20 are also within the scope of the present invention. Moreover, the working region 12 and disc 20 need not be co-extensive. For example, segments 14 may protrude over the periphery of substrate disc 20. A tool having such protruding segments 14 can provide improved grinding and/or cutting when grinding a workpiece near an obstacle. The portions of segments 14 protruding over the edge of disc 20 may be surrounded by a protective material, for example, a plastic, resinous, metal, or composite material. Any protective material can surround the protruding portions individually or by forming a shell around disc 20 and segments 14. The amount of protrusion may be from a fraction of a millimeter to about 5 millimeters, or greater, depending on the application and strength of segments 14.

A threaded cylinder 30, shown in FIG. 3, is attached to a second face 17' of substrate disc 20 that is opposite face 17. As shown, cylinder 30 is formed integrally with disc 20, but need not be. Threaded cylinder 30 allows attachment of tool 10 to a shaft (not shown) for rotatably driving tool 10. In this way, a workpiece (not shown) may be held in the vicinity of working region 12 as tool 10 is rotated to grind the workpiece.

In the embodiment shown in FIGS. 1, 2 and 3, abrasive segments 14 are rectangular in shape and circumferentially spaced on tool 10. Segments 14 are preferably laid out so as to define a surface of the working region 12 which when rotated provides a desired abrasion pattern. Segments 14 can cover all or only a portion of the radial distance of the tool 10 when rotated. As shown, each segment 14 extends from a location near the perimeter of tool 10 along a direction of a chord of the circle defined by tool 10 such that the length of segments 14 form an angle with a tangent line of the circle defined by the circular perimeter of tool 10 at the point from which each segment 14 extends. That is, the length of each segment 14 extends in this embodiment in a clockwise orientation on working region 12. The rotation of tool 10 is in a direction along arrow 11. This rotation direction causes the edges of segments 14 forming an obtuse angle with the tangent line defined above to contact a workpiece first during grinding.

Because abrasive segments 14 are used to form working region 12, rather than being formed from a single abrasive surface, tool 10 can be formed so that its grinding characteristics vary depending upon where in the working region 12 a workpiece is placed. For example, segments 14 can vary in length; as shown in FIG. 2, progressing around the perimeter of tool 10, a shorter segment 14*b* is followed by two longer segments 14*a*. This allows the amount of abrasive surface that a workpiece contacts in one rotation of the tool to be varied depending upon where on tool 10 a workpiece is held. If the workpiece is held near the perimeter of tool 10, in the path of all the segments 14, the workpiece contacts relatively more abrasive surface per rotation of tool 10. If the workpiece is held further towards the center of tool 10 so that it does not contact the relatively shorter segments 14*b*, a workpiece comes into contact with a relatively less abrasive surface. The amount of abrasive surface with which a workpiece comes into contact can affect grinding rate and tool wear rate.

Forming tool 10 with abrasive segments rather than a single abrasive surface also allows the abrasive particles to be placed along the radius of tool 10 substantially proportionally with the linear or rotational speed of the surface of tool 10. That is, at a radius more towards the center of tool 10, where the linear speed of a point on tool 10 is lower than that of a point nearer to the perimeter of tool 10, the concentration of abrasive particles can be lower than the concentration of hard particles at a radius more towards the perimeter of tool 10.

As shown in FIG. 3, segments 14 preferably extend completely through region 12 in an axial direction (that is, in a direction of the axis of rotation of tool 10) from the first planar face 17 of substrate disc 20 to the upper exposed surface 9 of working region 12. Each abrasive segment 14 has a grinding surface 19 raised above the first planar face 17 of disc 20 and exposed on the surface 9 of working region 12. In this way, as working region 12 wears down, a consistent cross-section of segments 14 will be exposed to a workpiece. In the embodiment shown in FIGS. 1, 2 and 3, each grinding surface 19 is rectangular in shape, however, other shapes for grinding surfaces 19, as segments 14, are also within the scope of the present invention.

Segments 14 may also protrude above the remainder of surface 9, or be slightly depressed therebelow. Surface 9 can be dressed or trued prior to or in the process of use of tool 10. This dressing or truing exposes new abrasive particles and can be done simultaneously or sequentially for segments 14 and the remainder of surface 9. It should be noted that surface 9 can be at least partially ground between segments 14 to provide a desired protrusion of segments 14 over surface 9. Also, segments 14 can be dressed without touching the remainder of surface 9 if the protrusion of segments 14 over the remainder of surface 9 is sufficient. During the process of dressing or truing, the direction of rotation of the dressing tool can be the same or different than the direction of rotation of tool 10. Segments 14 can protrude from the remainder of surface 9 a distance anywhere from a fraction of a millimeter to 15 millimeters or more, and preferably from 0.1 to 5 millimeters. It is also contemplated that segments 14 be embedded in protrusions of filler material which are raised above the remainder of the surface of the mounting plate.

In another embodiment, segments 14 may include at least one corrugated surface as a surface other than surface 19. A corrugated or rough surface on segment 14 can provide better integrity between segment 14 and filler material 16. Corrugation or indentations of these surfaces can be a result of material design and methods described in Tselesin, U.S. Pat. No. 5,190,568 for an Abrasive Tool With Contoured Surface, issued Mar. 2, 1993, and Reexamination Certificate B1-5,380,390 issued therefor on Mar. 12, 1996; Tselesin, U.S. Pat. No. 5,203,880 for a Method and Apparatus for Making Abrasive Tools, issued Apr. 20, 1993, and Reexamination Certificate B1-5,203,880 issued therefor on Oct. 17, 1995; Tselesin, U.S. Pat. No. 5,380,390 for a Patterned Abrasive material and Method, issued Jan. 10, 1995, and Reexamination Certificate B1-5,380,390 issued therefor on Oct. 1, 1996; and Tselesin, U.S. patent application Ser. No. 08/480,715, filed Jun. 7, 1995, currently assigned to the assignee of the present invention, all which are hereby incorporated by reference in their entirety.

Figure 8:
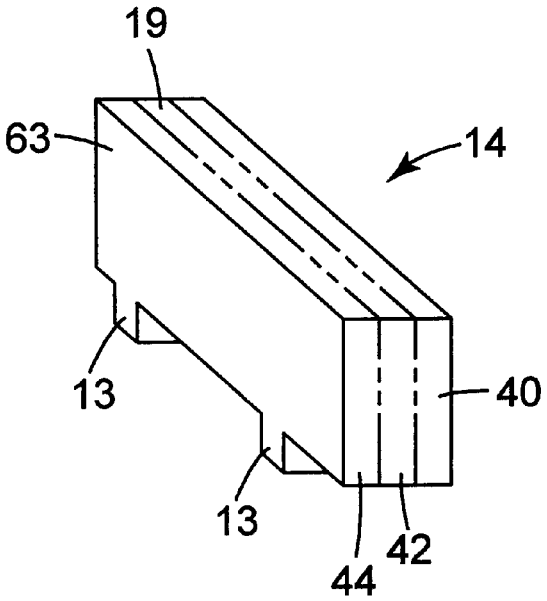
FIG. 8 is a perspective view of one of the plurality of abrasive segments shown in FIG. 1.
Figure 9:
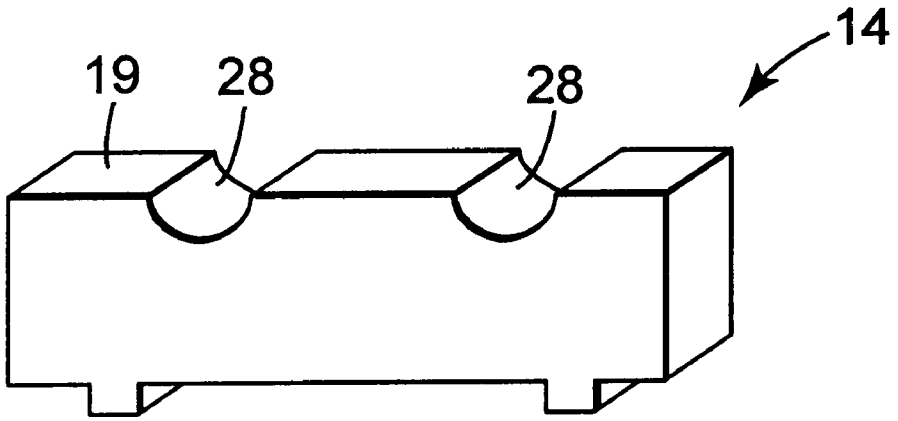
FIG. 9 is a perspective view of an second embodiment of one of the plurality of abrasive segments shown in FIG. 1.
Figure 10:
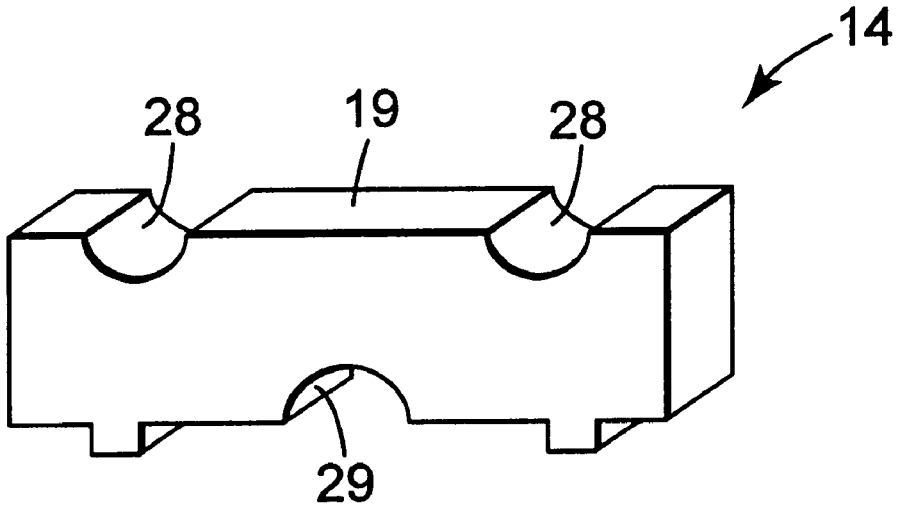
FIG. 10 is a perspective view of a third embodiment of one of the plurality of abrasive segments shown in FIG. 1.

Segments 14 may have a variety of shapes. In particular, grinding surface 19 may have a variety of configurations. FIG. 8 illustrates segment 14 having a rectangular cross-section and a substantially flat, rectangular grinding surface 19. However, grinding surface 19 may also be serrated or ridged. Alternately, FIG. 9 illustrates segment 14 having scoops 28 in grinding surface 19. Scoops 28 may be any shape, for example semi-circular, triangular, or square. Scoops 28 further reduce the area of abrasive surface 19 of segment 14 through a portion of the wear through it total thickness. Also, as shown in FIG. 10, segment 14 can include openings 29 on the opposite side of segment 14 from scoops 28. Filler material 16 flows into opening 29 when forming tool 10. As such, opening 29 improves the integrity of the interface between segment 14 and filler material 16. Also, when segments 14 wears below the level of scoops 28, opening 29 reduces the area of abrasive surface 19. It is also contemplated to form abrasive elements in a substantially trapezoidal or "pie" shape.

Segments 14 are defined by geometry, and/or size, and/or composition thereof, including but not limited to abrasive particle size, type, physical/mechanical properties of the segments, and retaining matrix composition. Segments 14 contain particles of abrasive or hard material including, but not limited to, superabrasives such as diamond, cubic boron nitride, and boron carbide, boron suboxide and/or silicon carbide suspended in a matrix of bond material. Segments 14 can contain such hard particles in a substantially homogeneous concentration or can contain varying concentrations of hard particles. It is also contemplated that segments 14 may contain different types of hard particles. Characteristics of, and preferred materials for forming, segments 14 are described below.

The concentration of superabrasive particles in segments 14, and therefore at each grinding surface 19, is relatively high. The concentration of hard particles in segments 14 can be discussed in terms of four quantities: linear particle concentration; concentration of particles in an exposed surface of segment 14; concentration of particles throughout the entirety of segment 14; and concentration of particles in an exposed surface of segment 14 in comparison to entire working region 12. Generally, linear particle concentration of segment 14 is between 20 to 1,000 hard particles per linear centimeter of each layer, and working surface 19 can have between 40 and 1,000,000 hard particles per square centimeter. As such, only a relatively small portion, for example 0.1%–60%, and preferably 5%–50%, of working region 12 need be made up of grinding surfaces 19.

Therefore, as shown in FIGS. 1, 2 and 3, only relatively narrow and/or short segments 14 need be mounted to disc 20 to form a highly effective grinding surface. This allows a wide range of configurations of segments 14 to be used in forming working region 12. Further, as noted above, the total abrasive area that a workpiece comes in contact with as tool 10 rotates can effect both the grinding rate and tool wear rate. And, because segments 14 are relatively narrow, these grinding characteristics of the grinding wheel of the present invention can be varied with relatively high precision simply by adding or subtracting the segments which would be in the grinding path of a workpiece.

Also, since segments 14 are relatively narrow and tool 10 comprises a limited number of segments, the force applied against the workpiece through tool 10 transforms into a large pressure against the workpiece and grinding surface 19. This results in a high rate of stock removal. Moreover, because only a relatively small portion of the surface of working region 12 is made up of abrasive or superabrasive segments, fabrication of tool 10 can be less expensive than a tool having a larger abrasive or superabrasive surface area.

Additionally, because there is a relatively high concentration of hard particles in segment 14, the concentration of bond material in which the hard particles are retained is relatively low. This has a number of advantages. First, the range of materials which can be used to dress tool 10 is increased. This is because the high concentration of hard particles in segments 14 reduces the amount of bond material needed therein. A lower amount of bond material makes it feasible to use a dressing tool having a softer working tip to dress tool 10 than would be required if the amount of bond material was greater. For example, if the amount of bond material were greater, a carbide or diamond tipped tool would likely be required to effectively dress tool 10. Second, less bond material reduces friction between the work piece and grinding tool. As such, less load is placed on the motor of the grinding machine. Third, use of relatively less bond material can be more cost effective if expensive bond material, for example cobalt, is used.

Filler material 16 surrounding segments 14 preferably does not include hard or abrasive particles or, instead, it may comprise a much lower concentration of such particles than segments 14. Accordingly, is it primarily the grinding surfaces 19 of segments 14 that act to abrade a workpiece as it is held against rotating tool 10. As noted above, filler material 16 preferably is substantially as thick in an axial direction as the segments 14 so as to together define the top surface 9 of the working region 12. In this way, a workpiece should be at least partially supported by both the filler 16 and segments 14 during rotation of tool 10. Therefore, the inclusion of filler 16 on tool 10 provides for quieter and smoother grinding operations. However, as detailed below, a grinding tool having abrasive or superabrasive segments and without filler material is also within the ambit of the present invention.

To increase lubricant or coolant flow to the working surface and to optionally facilitate removal of grinding debris as a workpiece is ground using tool 10, channels 18 are preferably formed in filler material 16 to extend from a central portion of region 12 to a perimeter edge thereof. Channel 18 can be arcuate as shown in FIGS. 1 and 2. Each channel 18 can include an aperture 24 at the end of the channel 18 nearest the center of region 12. Each aperture 24 extends through from a channel 18 to the opposite side of disc 20 allowing a lubricant or coolant such as water to be supplied through disc 20 and into each channel 18 to help remove grinding debris and/or reduce the temperature of a workpiece during grinding. Preferably, as illustrated in FIGS. 1, 2, and 3, channels 18 have an open surface to create a trough. Also apertures 24 can open within the cylinder 30 so that tool 10 can be used with a center waterfeed grinder. Channels or troughs 18 also provide a path for removal of grinding debris during grinding even if a lubricant is not fed therethrough. Alternately, channels 18 can be hidden under top surface 9 or face 17. Channels or troughs 18 are preferably provided in a radial configuration as viewed from the top. In the embodiment shown in FIGS. 1, 2, and 3, the concave side of the spiral faces the direction of rotation of tool 10, shown by arrow 11. Channels or troughs 18 may be any shape, for example conical, concave, or convex. Any cross-section or depth can be used for channels or troughs 18. A single tool may have a combination of different shaped channels, or may have channels which are branched between or around segments 14. Any number of channels may be used, generally from between 1 to 15, and preferably between 3 and 6. In one embodiment, a channel may end, or pass in close proximity to, a segment 14, so that any lubricant or coolant flowing through the channel may cool segment 14.

The filler material 16 may also include a lubrication additive. Examples of particulate lubricants include graphite and molybdenum sulfate. Alternately, cavities or capsules having known liquid lubricant therein can be mixed into filler material 16. These will then break down during use of the tool.

One method of fabricating abrasive segments such as segments 14 includes alternating layers of bond or filler material with layers of hard particles and sintering the layers together. Methods of sintering material to form abrasive articles is well known in the art and disclosed in Tselesin, U.S. Pat. No. 5,620,489 for a Method for Making Powder Preform and Abrasive Articles Made Therefrom, issued Apr. 15, 1997; Tselesin, U.S. Pat. No. 5,203,880 for Method and Apparatus for Making Abrasive Tools, issued Apr. 20, 1993 and Reexamination Certificate Serial No. B1-5,203,880 issued therefor on Oct. 17, 1995; deKok et al., U.S. Pat. No. 5,092,910 for Abrasive Tool issued Mar. 3, 1992 and Reexamination Certificate Serial No. B1-5,092,910 issued therefor on Sep. 26, 1995; Tselesin, U.S. Pat. No. 5,049,165 for Composite Material issued Sep. 17, 1991 and Reexamination Certificate Serial No. B1-5,049,165 issued therefor on Sep. 26, 1995; deKok et al., U.S. Pat. No. 4,925,457 for Abrasive Tool and Method for Making, issued May 15, 1990 and Reexamination Certificate Serial No. B1-4,925,457 issued therefor on Sep. 26, 1995; Tselesin, U.S. Pat. No. 5,190,568 for Abrasive Tool with Contoured Surface, issued Mar. 2, 1993 and Reexamination Certificate Serial No. B1-5,190,568 issued therefor on Mar. 12, 1996; U.S. patent application Ser. No. 08/480,715 filed Jun. 7, 1995, currently assigned to the assignee of the present invention; and U.S. patent application Ser. No. 08/728,169, filed Oct. 9, 1996, currently assigned to the assignee of the present invention. Each of these references is hereby incorporated by reference in its entirety. For the most part, the technology and products described in these references relate to products sold by Ultimate Abrasive Systems, Inc. of Atlanta Georgia and Minnesota Mining and Manufacturing of St. Paul, Minn. under the tradename of DIAMESH. It should be understood that any conventional material comprising hard particles, including but not limited to sintered mixtures, green compacts, and any other compositions and forms of sinterable material (such as metals and ceramic powders and powder tapes) can be used to produce segments 14.

Figure 4:
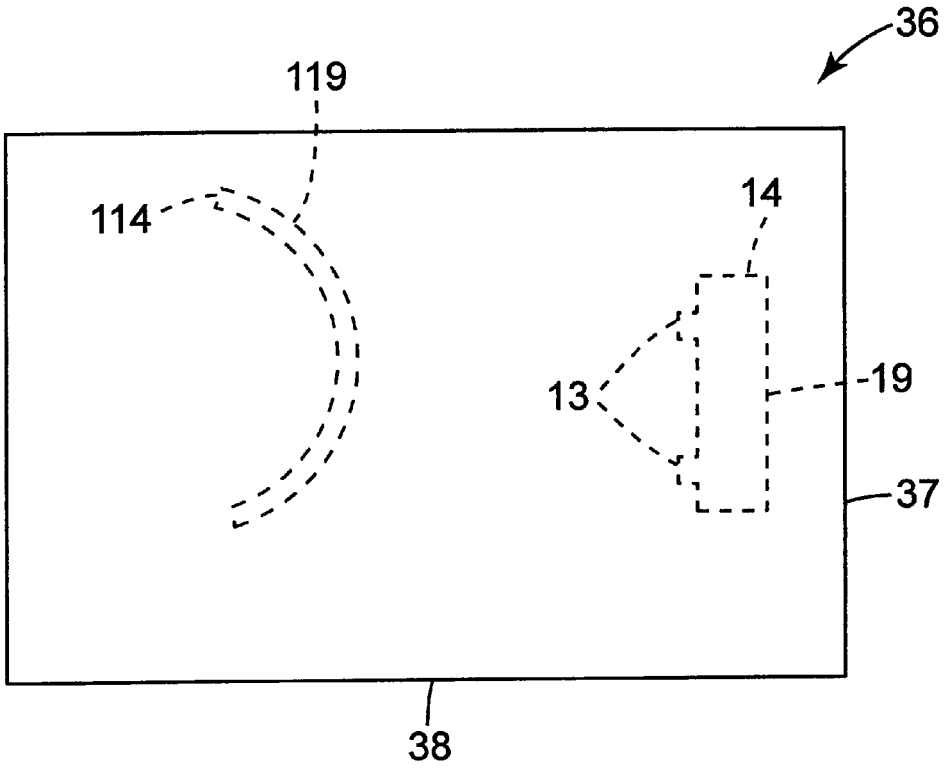
FIG. 4 is a top view of a laminated sheet used to fabricate the abrasive segments shown in FIG. 1.

To form segments 14 in accordance with a predetermined method, a laminated sheet 36, shown in a top view in FIG. 4, is formed. In the embodiment of FIG. 4, laminated sheet 36 is rectangular with a front edge 37 and a side edge 38. However, other shapes of laminated sheet 36 are also within the scope of the present invention. Sheet 36 is made up of a plurality of thickness layers. Each thickness layer preferably includes a layer of bond material and a layer of hard particles. Each thickness layer of sheet 36 can also include a layer of porous material and/or adhesive substrate. Conventional materials can be used by themselves to produce plate 36 or in a combination with the laminated layers.

Figure 5:
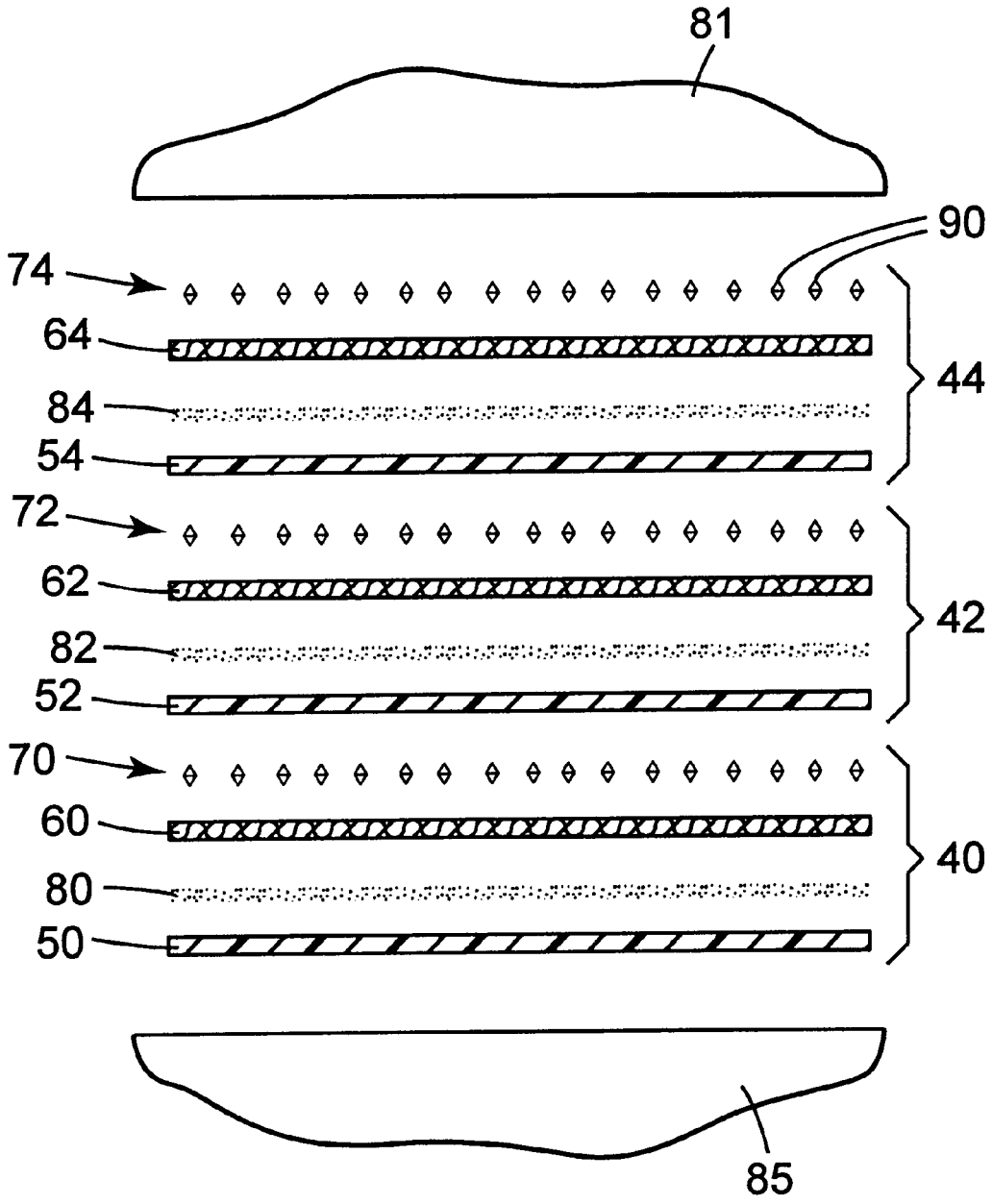
FIG. 5 is an exploded front view of the laminated sheet shown in FIG. 4.

FIG. 5 is an exploded front view of front edge 37 of sheet 36 showing the stack up of thickness layers which can be used in the fabrication of segments 14. Sheet 36 is preferably made up of three thickness layers 40, 42, and 44. Each thickness layer 40, 42, and 44 includes a bond material layer 50, 52, and 54, respectively; a porous material layer 60, 62, and 64, respectively; and a hard particle layer 70, 72, and 74, respectively, of hard particles 90. Each thickness layer 40, 42, and 44 may also include adhesive layers 80, 82, and 84, respectively, placed on one face of the porous material layers 60, 62, and 64, respectively, and each having at least one face which includes a pressure sensitive adhesive. The adhesive face of the adhesive layers 80, 82, and 84 are positioned against the porous layers 60, 62, and 64, respectively. In this way, when hard particles 90 of hard particle layers 70, 72, and 74 are placed in the openings of the porous layers 60, 62, and 64, respectively, the hard particles 90 adhere to the adhesive layers 80, 82, and 84 such that the hard particles 90 are retained in the openings of the porous layers 60, 62, and 64. It should be understood that the above mentioned porous layers may be selected from, for example, mesh-type materials (e.g., woven and non-woven mesh materials, metallic and non-metallic mesh materials), vapor deposited materials, powder or powder-fiber materials, and green compacts, all which include pores or openings distributed throughout the material.

The porous layer may be separated or removed from the adhesive layer after the hard particles have been received by the adhesive layer. The use of adhesive substrates to retain hard particles to be used in a sintering process is disclosed in U.S. Pat. No. 5,380,390 to Tselesin and U.S. Pat. No. 5,620,489 to Tselesin and U.S. patent application Ser. No. 08/728,169, filed Oct. 9, 1996, currently assigned to the assignee of the present invention, each of which has been incorporated by reference in its entirety.

Thickness layers 40, 42, and 44 are compressed together by top punch 84 and bottom punch 85 to form sintered laminated sheet 36. As noted above, sintering processes suitable for the present invention are known in the art and described in, for example, in U.S. Pat. No. 5,620,480, to Tselesin, which has been incorporated by reference in its entirety. Further, the details of a sintering process which can be used in fabricating sheet 36 are given below in the Examples. Though FIG. 5 shows a single bond material layer for each thickness layer 40, 42, and 44, it is also contemplated to include 2 or more bond layers for each thickness layer 40, 42, and 44. Additionally, it is within the scope of the present invention to have either fewer or greater than three thickness layers.

Figure 6:
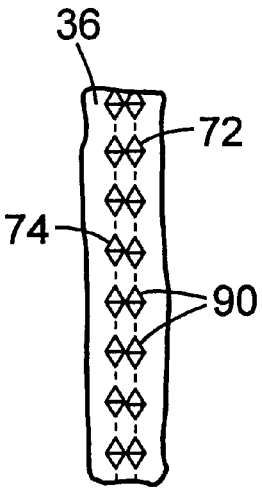
FIG. 6 is a partial side view of the laminated sheet shown in FIG. 4 showing adjacent layers of hard particles in contact with one another.
Figure 7:
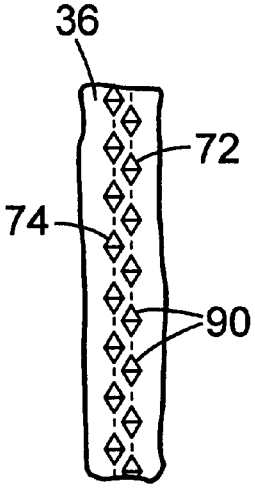
FIG. 7 is a partial side view of the laminated sheet shown in FIG. 4 showing adjacent layers of hard particles slightly overlapped with one another.

Also, the hard particles 90 of hard particle layers 70, 72, and 74 can be arranged adjacent to the bond material layers 50, 52, and 54, respectively, without any porous material layers or adhesive substrate layers. If layers of porous material 60, 62, and 64 are used, they can be removed after placement of the hard particles 90 and before sintering but need not be. It is also contemplated to form one or more thickness layers having no hard particles. These thickness layers can act as reinforcing layers alternating between thickness layers having hard particles. Such reinforcing layers can include the same or different segments from the bond material layers including, but not limited to copper, tin, zinc, nickel, cobalt, steel, chromium, tungsten, tungsten carbide, and molybdenum. During the sintering process, it is also possible that the hard particle layers will be pressed together such that a portion of the planes of adjacent hard particle layers will either touch each other, as shown in FIG. 6, or overlap with one-another in the interstitial points between particles in a single layer, as shown in FIG. 7. The planes of what were the hard particle layers 72 and 74 before sintering are shown in phantom in both FIGS. 6 and 7.

Figure 12:
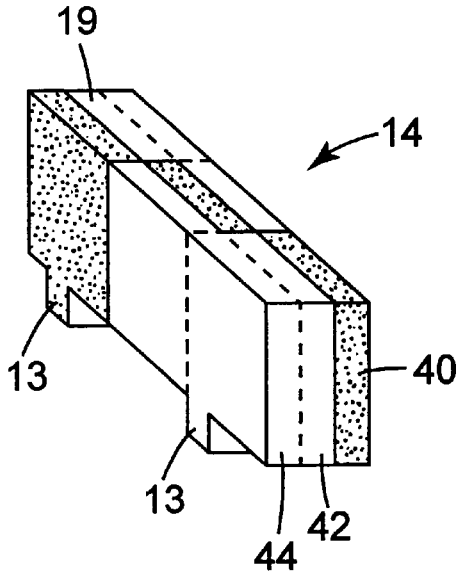
FIG. 12 is a perspective view of a forth embodiment of one of the plurality of abrasive segments shown in FIG. 1.
Figure 13:
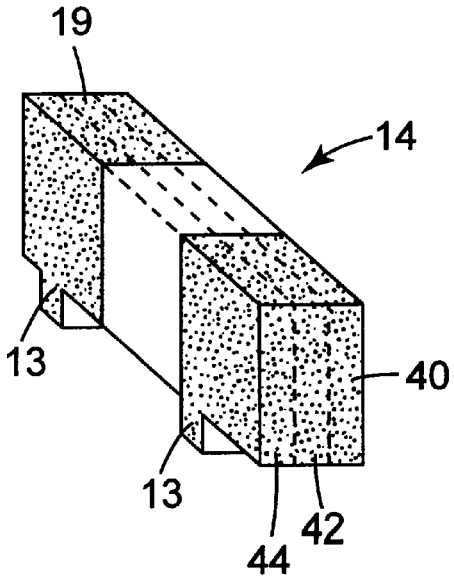
FIG. 13 is a perspective view of a fifth embodiment of one of the plurality of abrasive segments shown in FIG. 1.

Types of bond material layers can also be alternated between thickness layers and types, concentrations and/or sizes of hard particles can be alternated between thickness layers. In this way, abrasive, wear, and strength properties of segment 14 can be varied. FIGS. 12 and 13 are perspective views of alternative embodiments of segments 14 showing the varying concentrations or types of hard particles therein. Shaded regions show relatively high concentrations of hard particles and un-shaded regions show areas of relatively low concentrations of or no hard particles or a different type of hard particle than in the shaded regions. For example, FIG. 12 shows an embodiment of an segment 14 in which regions of high concentration of hard particles alternate between thickness layers 40, 42, and 44. FIG. 13 shows an embodiment of a segment 14 in which regions of high concentration of hard particles alternate in each thickness layer 40, 42, and 44 and there is alignment between thickness layers of the regions of high concentration and low concentration.

Figure 14:
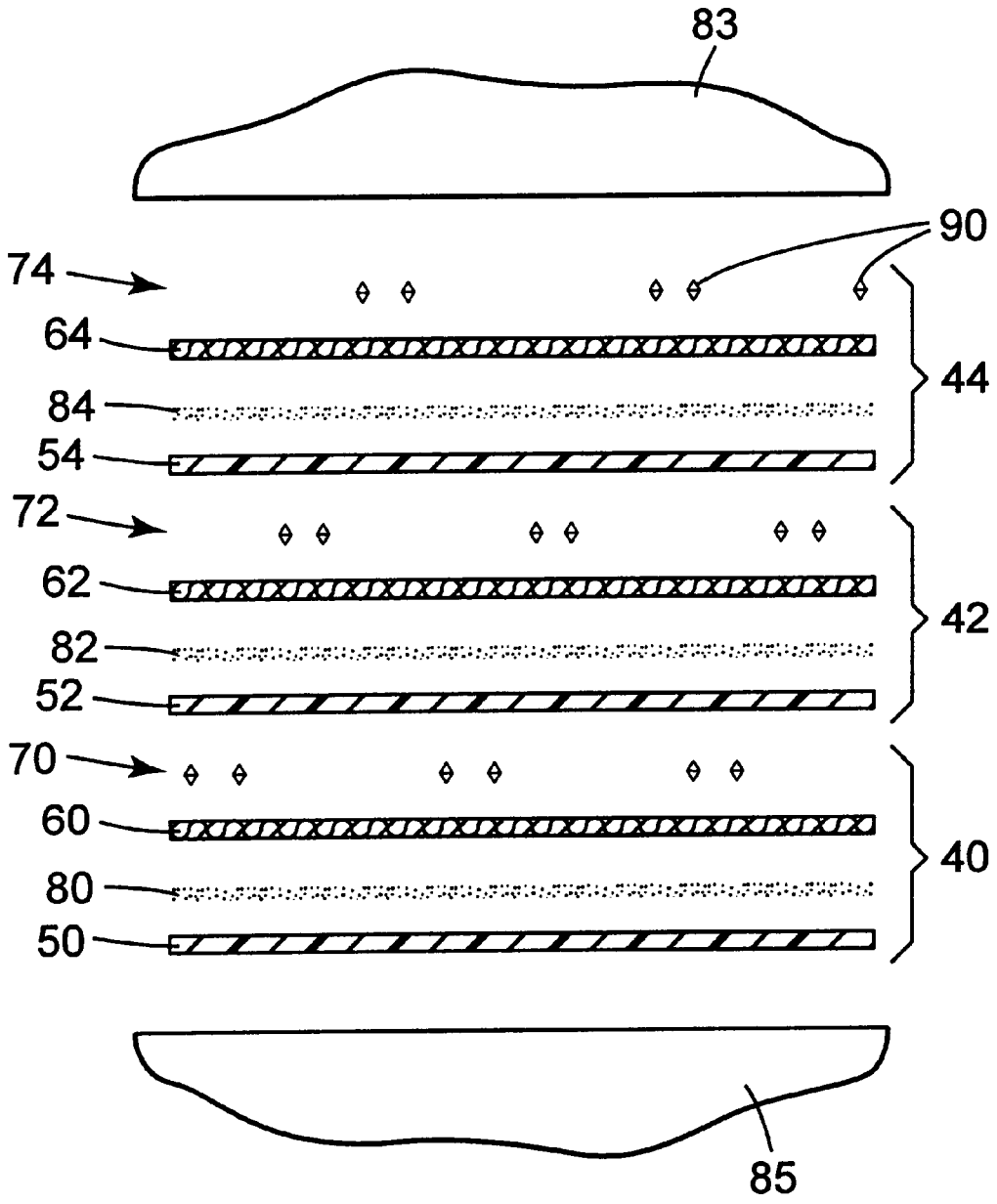
FIG. 14 is an exploded front view of a second embodiment of the laminated sheet shown in FIG. 4.

To form a segment 14 in which the concentration of hard particle varies as shown in FIG. 12, the stack up of thickness layers in laminated sheet 36 is as shown in FIG. 14. Each layer of hard particles 70, 72 and 74 has two rows of hard particles 90 running parallel to edge 38 between 4 empty rows. The rows of particles are offset between adjacent hard particle layers 70, 72, and 74. Sheet 36 is then cut as described above to form segments 14. Segments including other configurations of regions having higher and lower concentrations of hard particles and/or different types of hard particles are also within the scope of the present invention. Such segments and methods for fabricating such segments are fully disclosed in co-pending U.S. patent application Ser. No. 08/882,434 filed on Jun. 25, 1997, currently assigned to the assignee of the present invention, and which is hereby incorporated by reference in its entirety.

After the thickness layers 40, 42, and 44 are sintered together to form laminated sheet 36, segments can be cut by a laser, water jet, EDM (electrical discharge mechanism), plasma electron-beam, scissors, blades, dies, or other known method from sheet 36 as shown in phantom in FIG. 4. Segment 14, having alternating concentrations of hard particles and binder material can also be manufactured by a combination of sintered pieces having uniform, but different, concentrations of particles and bond. These pieces can be cut from laminated sheets 36 by the above mentioned methods and then assembled together in a desired sequence by brazing, welding, or other know methods.

Preferably, as shown in FIG. 8, which is a perspective view of an individual segment 14, each segment 14 includes feet 13 which are placed in apertures in substrate disc 20 sized to accommodate feet 13. In this way, feet 13 are used in spacing, aligning and mounting segments 14 to substrate disc 20. Segments 14 can be spaced and mounted to substrate disc 20 by brazing, welding, adhesive, rubber, or other known means. It should be noted that feet 13 represent only one embodiment of this invention, and that segments 14 may also be made without feet 13. In the case where no feet are present, as well as in the case where feet are utilized, segment 14 can be inserted into a slot in the surface of disc 20 which corresponds to the overall shape of segment 14. It is also contemplated that feet 13 be attached to the remainder of a segment 14 via a narrowed neck. This allows feet 13 to be removably "locked" into lipped slots in disc 20.

Hard particles may be located throughout segment 14 including feet 13, or segment 14 may be prepared so that no hard abrasive particles are located in feet 13. This can be done by forming strips in sheet 36 parallel to edge 37 which are void of abrasive particles. Then, segments 14 can be cut from sheet 36 such that feet 13 are formed by portions of the strips having no hard particles.

In the embodiment of FIG. 1, segments 14 extend generally perpendicularly from disc 20 such that the edges of segments 14 which were cut to form segments 14 from sheet 36 are exposed at working region 12 to form grinding surfaces 19. In this way, laminated thickness layers 40, 42, and 44 are mounted to disc 20 at a substantially 90 degree angle. As will be further detailed below, it is within the scope of the present invention, however, to mount segments 14 to disc 20 such that a face 63 of element 14 substantially parallel with laminated thickness layers 40, 42, and 44 forms an angle anywhere between 0 degree and 180 degrees, exclusive, with the surface of disk 20, That is, an angle greater than 0 degrees. Grinding surfaces 19 are generally parallel to substrate disc 20 and primarily act to abrade a workpiece. In this way, and as shown in FIG. 8 in phantom, each grinding surface 19 is substantially perpendicular, or at an angle of substantially 90 degrees, to the planes of the thickness layers 40, 42, and 44 which make up each segment 14. That is, each grinding surface 19 cuts across thickness layers 40, 42 and 44. It is also contemplated, however, to form the planes of thickness layers 40, 42 and 44 at any angle between 0 degrees and 180 degrees, exclusive, with each grinding surface 19 of segments 14. Forming segments 14 in this way avoids a situation in which an entire layer of hard particles has been worn off of each grinding surface 19 so that only a layer of bond material is exposed before reaching the next layer of hard particles. It should be understood that some segments 14 can be mounted on disc 20 so that thickness layers 40, 42 and 44 and face 63 form alternating layers with disc 20.

Figure 11A:
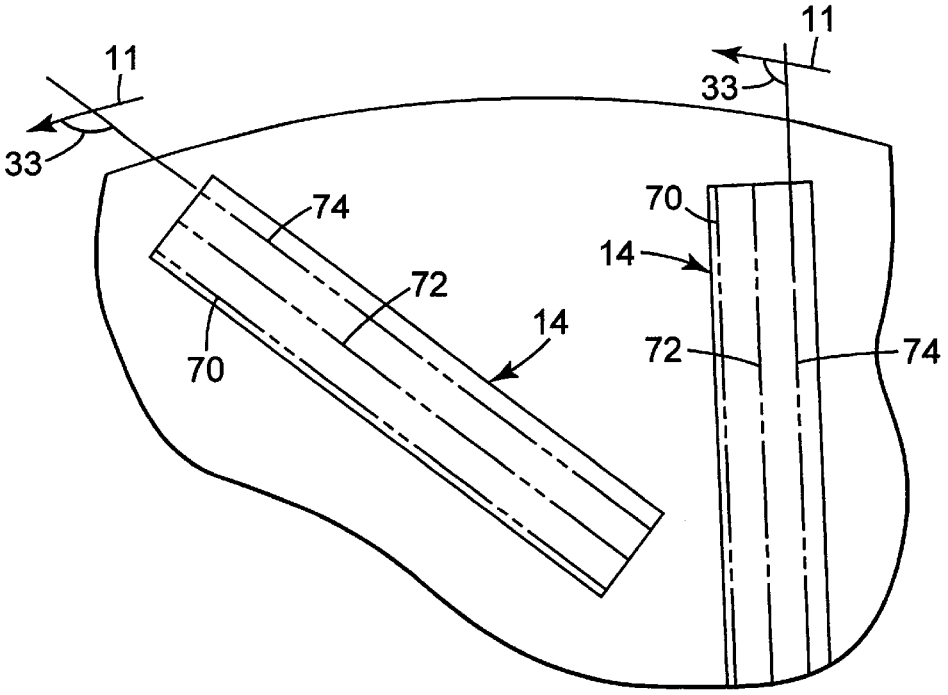
FIG. 11A is a partial top view of the grinding tool shown in FIG. 1 showing the orientation of the thickness layers of the abrasive segments with respect to the direction of rotation of the grinding tool.

As shown in phantom in FIG. 11A, which illustrates the orientation of hard particle layers 70, 72, and 74 in segments 14, the direction of travel 11 of tool 10 is such that the hard particle layers 70, 72, and 74 of segments 14 strike a workpiece at an angle 33 other than 0 degrees or 180 degrees. That is, angle 33 is between 0 degrees and 180 degrees, exclusive. Moreover, forming sheet 36 and segments 14 from thickness layers 40, 42 and 44 as described above can result in a distribution of hard particles in segments 14 which is non-isotropic. That is the linear concentration of hard particles in a direction parallel to the thickness layers 40, 42 and 44 can be higher than the linear concentration of hard particles in a direction perpendicular to the thickness layers 40, 42 and 44. This is so because of planar regions of bond and porous material intervening between what were, before sintering, hard particle layers 70, 72 and 74, depicted in phantom in FIG. 11A.

Figure 11B:
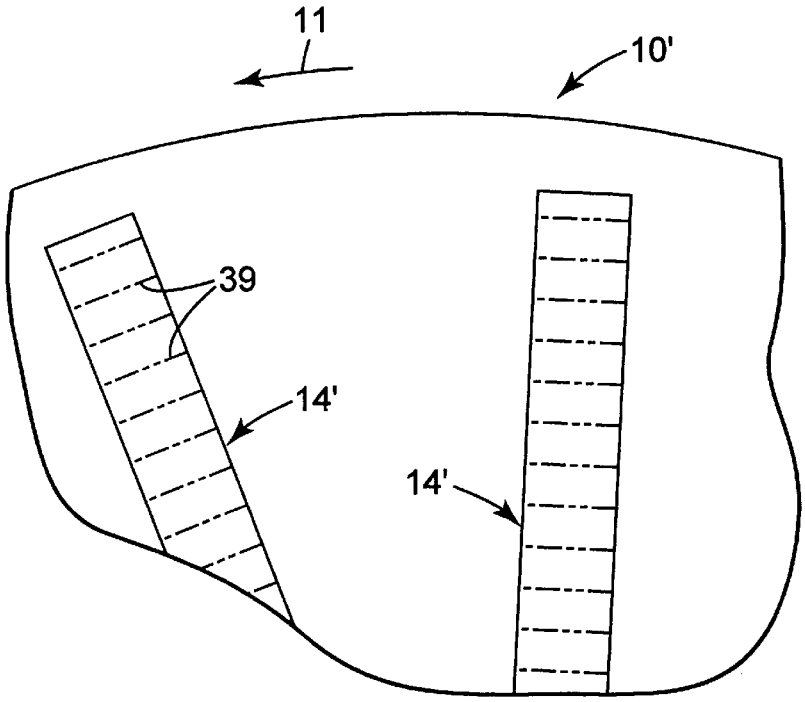
FIG. 11B is a partial top view of another embodiment the grinding tool shown in FIG. 1 showing an alternate orientation of the thickness layers in the abrasive segments with respect to the direction of rotation of the grinding tool.

The layered regions of bond and porous material which can be formed between hard particle layers 70, 72, and 74 wear faster than the regions of segments 14 having hard particles. As such, if the thickness layers were aligned substantially parallel with the direction of travel of the tool, as shown in FIG. 11B which illustrates a tool 10' having segments 14' in which the thickness layers are so aligned, linear grooves 39, depicted in phantom in FIG. 11B, will likely be worn in the regions of bond and porous material intervening between the planar layers of hard particles. Grooves 39 would leave the hard particles without lateral support in segments 14'. Without lateral support, hard particles could be prematurely dislodged from segments 14' causing segments 14' to wear relatively more rapidly and decreasing the useful life of tool 10'. By mounting segments 14 on disc 20 such that thickness layers 40, 42, and 44 are perpendicular to or otherwise at an angle other than 0 or 180 degrees, to the direction of travel 11 of tool 10, linear grooves like grooves 39 are less likely to form in the regions of segments 14 that do not contain hard particles. As such, the hard particles retain more lateral support as tool 10 is used and are less likely to prematurely dislodge from segments 14. This can decrease the wear rate of tool 10 and increase its useful life.

Substrate disc 20 and threaded cylinder 30 can be formed from steel and machined from a single steel blank. Threaded cylinder 30 may be replaced with any attachment system, for example, a magnetic coupling or mechanical "snail" coupling. Preferably, however, disc 20 is machined from a steel blank and threaded cylinder 30, which can be separately formed from steel or any other rigid material, is mounted or otherwise integrated onto face 17' of disc 20 by adhesive, welding, brazing, or any other method known in the art. Apertures are formed by drilling, laser cutting, or other known methods in the planar face 17 of disc 20 to accommodate the feet 13 of segments 14.

Filler material 16 is cast around segments 14 and on disc 20 such that grinding surfaces 19 of segments 14 remain exposed. A mold is pre-filled with the filler material 16 and disc 20 with segments 14 mounted thereto is placed in the mold. The filler material 16 is then allowed to cure and tool 10 is removed from the mold. Filler material is preferably an epoxy resin. A specific composition of an epoxy resin which can be used as filler material 16 is included in the Examples below. Alternate preferred filler materials are phenolic resins and urethane resins. Any rubber materials may also be useful as filler materials. Channels 18 can be carved, embossed, molded or otherwise formed in filler material 16.

In carrying out the above fabrication process, the bond material making up bond material layers 50, 52 and 54 can be any material sinterable with the hard particle layers 70, 72, and 74 and is preferably soft, easily deformable flexible material (SEDF) the fabrication of which is known in the art and is disclosed in U.S. Pat. No. 5,620,489 to Tselesin which has been incorporated by reference in its entirely. Such SEDF can be formed by forming a paste or slurry of bond material or powder such as tungsten carbide particles or cobalt particles, and a binder composition including a cement such as rubber cement and a thinner such as rubber cement thinner. Hard particles can also be included in the paste or slurry but need not be. A substrate is formed from the paste or slurry and is solidified and cured at room temperature or with heat to evaporate volatile components of the binder phase. The SEDF used in the embodiment shown in FIG. 5 to form bond material layers 50, 52, and 54 can include methylethylketone:toluene, polyvinyl butyral, polyethylene glycol, and dioctylphthalate as a binder and a mixture of copper, iron nickel, tin, chrome, boron, silicon, tungsten carbide, cobalt, and phosphorus as a bond matrix material. Certain of the solvents will dry off after application while the remaining organics will bum off during sintering. An Example of an exact composition of an SEDF that may be used with the present invention is set out below in the Examples. Components for the composition of such an SEDF are available at a number of suppliers including: Sulzer Metco, Inc. of Troy, Mich.; All-Chemie, Ltd. of Mount Pleasant, S.C.; Transmet Corp. of Columbus, Ohio; Valimet, Inc., of Stockton, Calif., CSM Industries of Cleveland, Ohio; Engelhard Corp. of Seneca, S.C.; Kulite Tungsten Corp. of East Rutherford, N.J.; Sinterloy, Inc. of Selon Mills, Ohio; Scientific Alloys Corp. of Clifton, N.J.; Chemalloy Company, Inc. of Bryn Mawr, Pa.; SCM Metal Products of Research Triangle Park, N.C.; F.W. Winter & Co. Inc. of Camden, N.J.; GFS Chemicals Inc. of Powell, Ohio; Aremco Products of Ossining, N.Y.; Eagle Alloys Corp. of Cape Coral, Fla.; Fusion, Inc. of Cleveland, Ohio; Goodfellow, Corp. of Berwyn, Pa.; Wall Colmonoy of Madison Hts, Mich.; and Alloy Metals, Inc. of Troy, Mich. It should also be noted that not every bond layer forming sheet 36 need be of the same composition; it is contemplated that one or more bond material layers could have different compositions.

The porous material can be virtually any material so long as the material is substantially porous (about 30% to 99.5% porosity) and preferably comprises a plurality of non-randomly spaced openings. Suitable materials are organic or metallic non-woven, or woven mesh materials, such as copper, bronze, steel, or nickel wire mesh, or fiber meshes (e.g. carbon or graphite). Particularly suitable for use with the present invention is a stainless steel wire mesh. In the embodiment shown in FIG. 5, a mesh is formed from a first set of parallel wires crossed perpendicularly with a second set of parallel wires to form porous layers 60, 62, and 64. The exact dimensions of a stainless steel wire mesh which can be used with the present invention is disclosed below in the Examples.

Figure 5A:
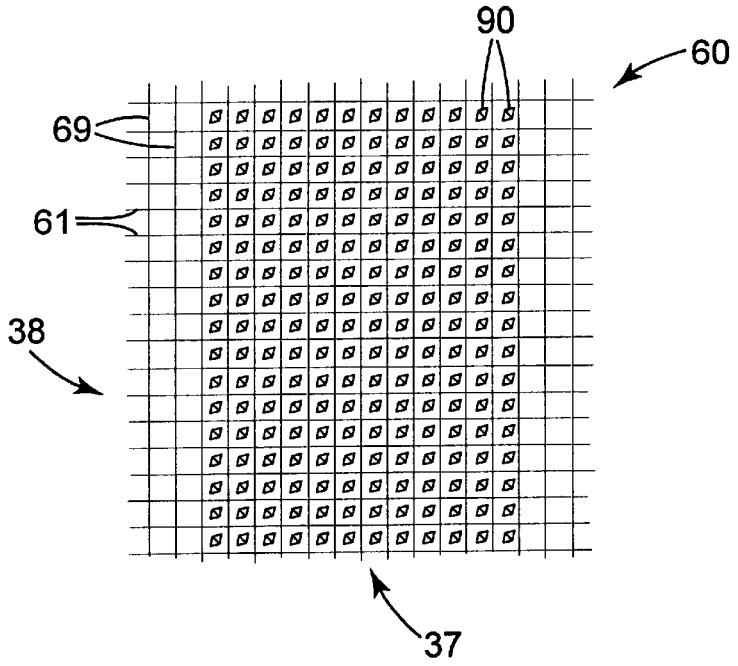
FIG. 5A is a top view of a first embodiment of porous material which can be used to fabricate the laminated sheet shown in FIG. 4.
Figure 5B:
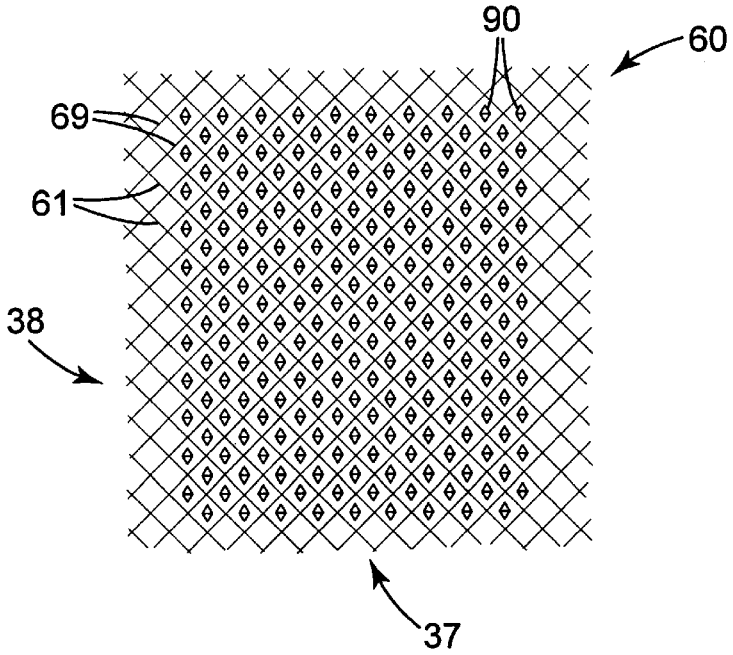
FIG. 5B is a top view of a second embodiment of porous material which can be used to fabricate the laminated sheet shown in FIG. 4.

As shown in FIG. 5A, which is a top view of a single porous layer 60 of sheet 36 having hard particles 90 placed therein, a first set of parallel wires 61 can be placed parallel with front edge 37 of sheet 36 and the second set of parallel wires 69 can be placed parallel to side edge 37. However, as shown in FIG. 5B it is also possible to angle the porous layer such that the sets of parallel wires 61 and 69 are at an approximately 45 degree angle with front edge 37 and side edge 38. The latter arrangement has the advantage of exposing more hard particles 90 at the cutting edge of a work surface when segment 14 is cut from sheet 36. It is also contemplated to form sheet 36 having some layers using the configuration of FIG. 5B and some layers using the configuration of FIG. 5A.

The hard particles 90 can be formed from any relatively hard substance including superabrasive particles such as diamond, cubic boron nitride, boron suboxide, boron carbide, and/or silicon carbide. Preferably diamonds of a diameter and shape such that they fit into the holes of the porous material are used as hard particles 90. It is also contemplated to use hard particles that are slightly larger than the holes of the porous material and/or particles that are small enough such that a plurality of particles will fit into the holes of the porous material.

The adhesive layers 80, 82, and 84 can be formed from a material having a sufficiently tacky quality to hold hard particles at least temporarily such as a flexible substrate having a pressure sensitive adhesive thereon. Such substrates having adhesives are well known in the art. The adhesive must be able to hold the hard particles during preparation, and preferable should burn off ash-free during the sintering step. An example of a usable adhesive is a pressure sensitive adhesive commonly referred to as Book Tape #895 available from Minnesota Mining and Manufacturing Company (St. Paul, Minn.).

Figure 15:
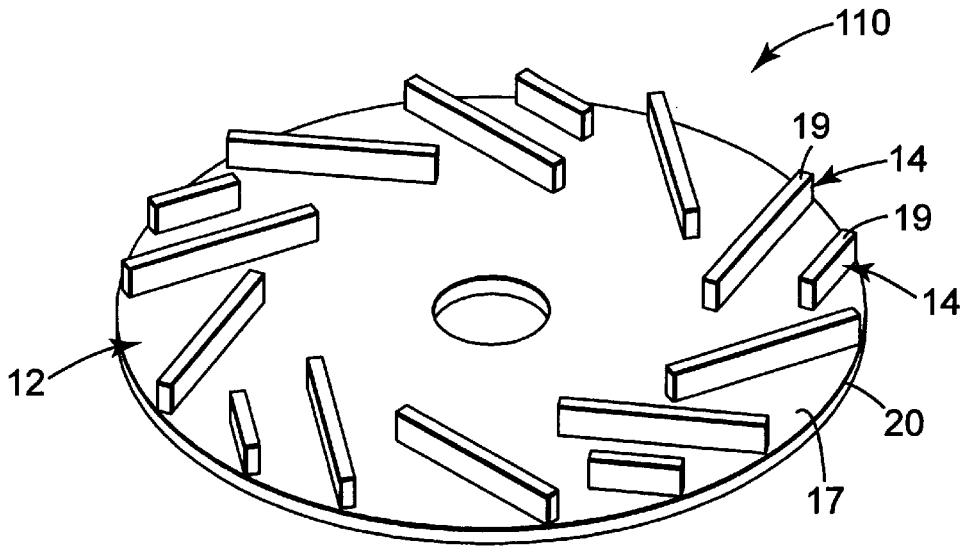
FIG. 15 is a perspective view of the grinding tool shown in FIG. 1 but without filler material.

As noted above, it is also within the ambit of the present invention to form tool 10 without the filler material 16. As shown in FIG. 15, segments 14 can be mounted to disc 20 as described above with respect to FIGS. 1, 2 and 3, and tool 10 can be used without filler material 16. As illustrated, the segments 14 are arranged similarly as in FIG. 1 to present a similar abrasive pattern, however, no filler material 16 has been cast around segments 14. This can reduce expense in fabrication of tool 10.

Figure 16:
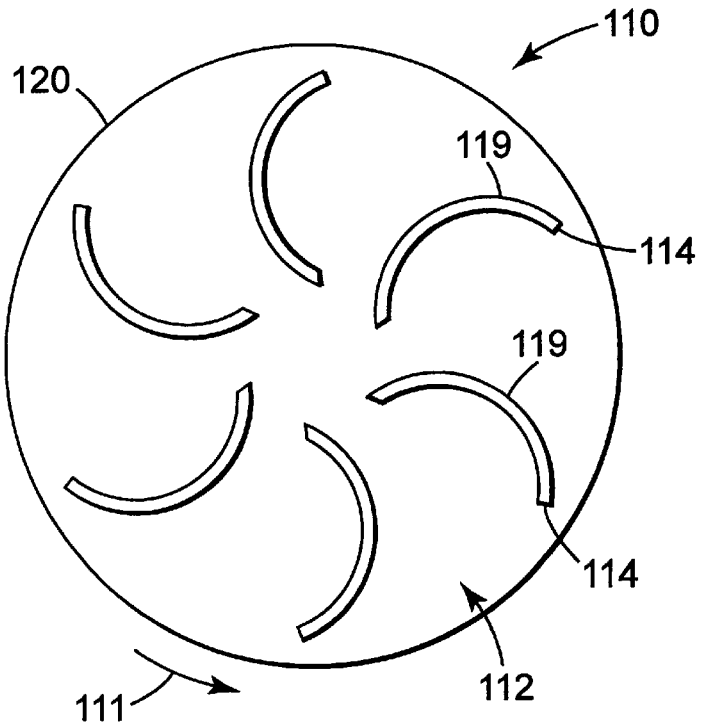
FIG. 16 is a top view of a second embodiment of a grinding tool including a plurality of arcuate abrasive segments in accordance with the present invention.

FIG. 16 shows another embodiment of the present invention in which the abrasive segments are formed in arcuate sections and without filler material. Features in FIG. 16 functionally similar to those of FIGS. 1 and 2 are shown with like numerals incremented by 100. Segments 114 are formed in substantially the same manner as segments 14 of FIGS. 1 and 2. Segments 114 can be cut from sheet 36 as shown in phantom in FIG. 4. Segments 114 are then mounted to a mounting plate in the form of substrate disc 120 such that the grinding surface 119 of each arcuate segment 114, that is the face of each arcuate segment 114 which is formed by cutting across thickness layers 40, 42 and 44 of sheet 36, is perpendicular to a first planar face 117 of disc 120. Grinding surfaces 119 form a portion of working region 112. To grind a workpiece, tool 110 is generally rotated in the direction of arrow 111 such that grinding surfaces 119 of segments 114, which are on the convex side of segments 114 and perpendicular to planar surface 117, contact the workpiece. It is also contemplated to form segments 114 having other arcuate shapes. As with tool 10 of FIG. 1, 2, and 3, because the concentrations of hard particles at the working surfaces 119 of segments 114 are relatively high, a relatively small portion, generally about 0.1% to about 60% and preferably about 5% to 50%, of working region 112 is made up of grinding surfaces 119.

Figure 34:
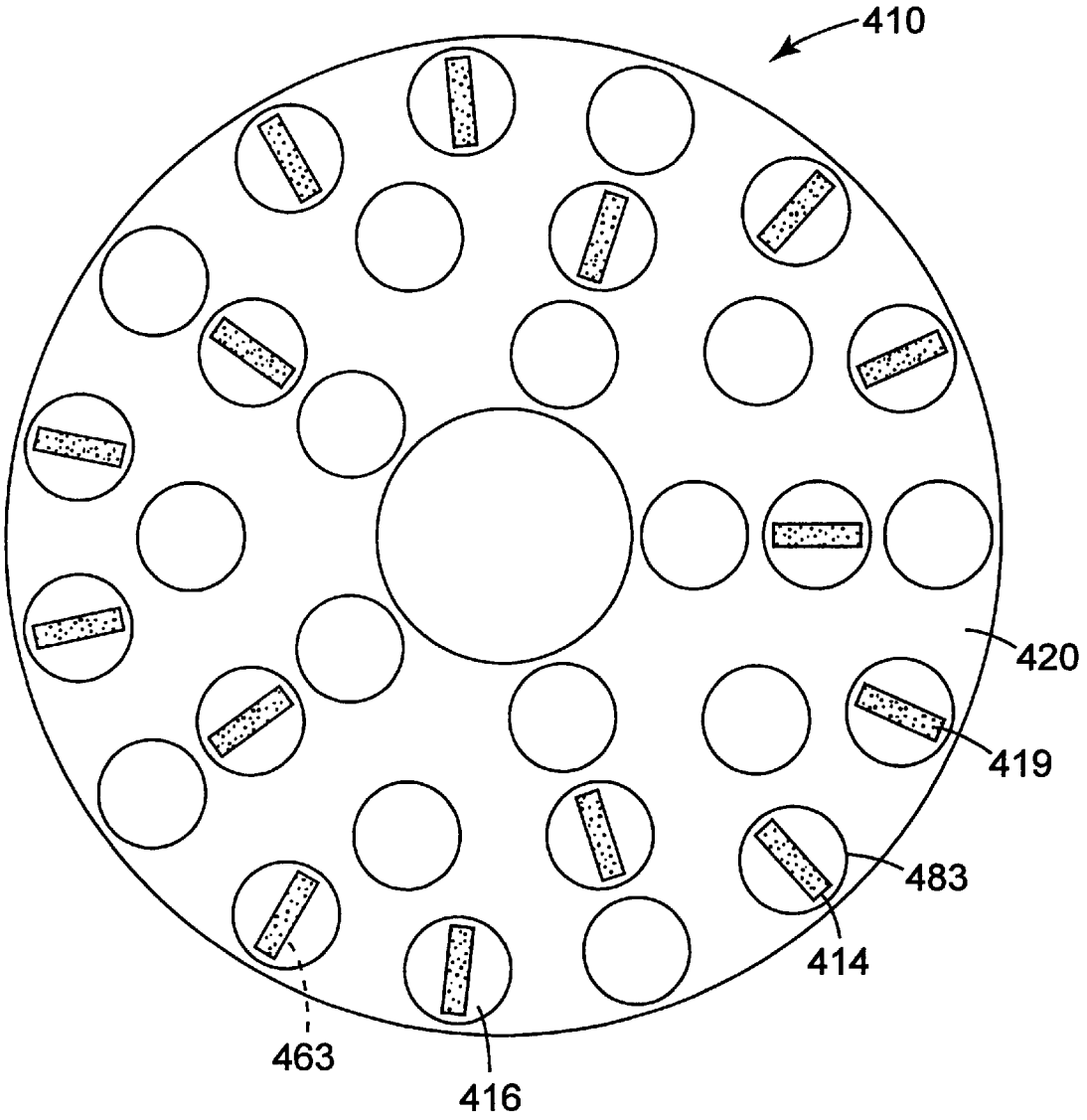
FIG. 34 is a top view of an alternate embodiment of a grinding tool including a plurality of abrasive elements mounted on a mounting plate and contained in areas of raised filler material in accordance with the present invention.

Another embodiment of the present invention is shown in FIG. 34. Elements in FIG. 34 functionally similar to those of FIGS. 1 and 2 are shown with like numerals incremented by 400. Tool 410 includes mounting plate 420 and protrusions 483 which support abrasive or superabrasive elements 414. A top surface of each protrusion 483 is raised above the top surface of mounting plate 420 to substantially the same level as the grinding surfaces 419 of elements 414. Mounting plate 420 and protrusion 483 are all formed unitarily from filler material 416. Alternatively, the protrusions may be removable plugs which can be replaced when worn. Tool 410 can be formed by placing elements 414 in a mold and filling in filler material 416 around elements 414. The composition of filler material 416 can be the same as the composition of filler material 16. Also, elements 414 are mounted in tool 410 such that a face 463 of each element 414 substantially parallel to the thickness layers 40, 42, and 44 which form elements 414 is at an angle of between 0 degrees and 180 degree, exclusive, with the mounting surface 420. Preferably, the face 463 of each element substantially parallel to the thickness layers 40, 42, and 44 is substantially perpendicular to the mounting surface 420.

Additional embodiments of the present invention are shown in FIGS. 17 through 25. In each case, abrasive segments are provided having grinding surfaces which are at an angle other than 90 degrees to the surface of the substrate disc. Features in FIGS. 17 through 25 structurally similar to those of FIGS. 1, 2 and 3 are shown with like numerals incremented by 200.

Figure 17:
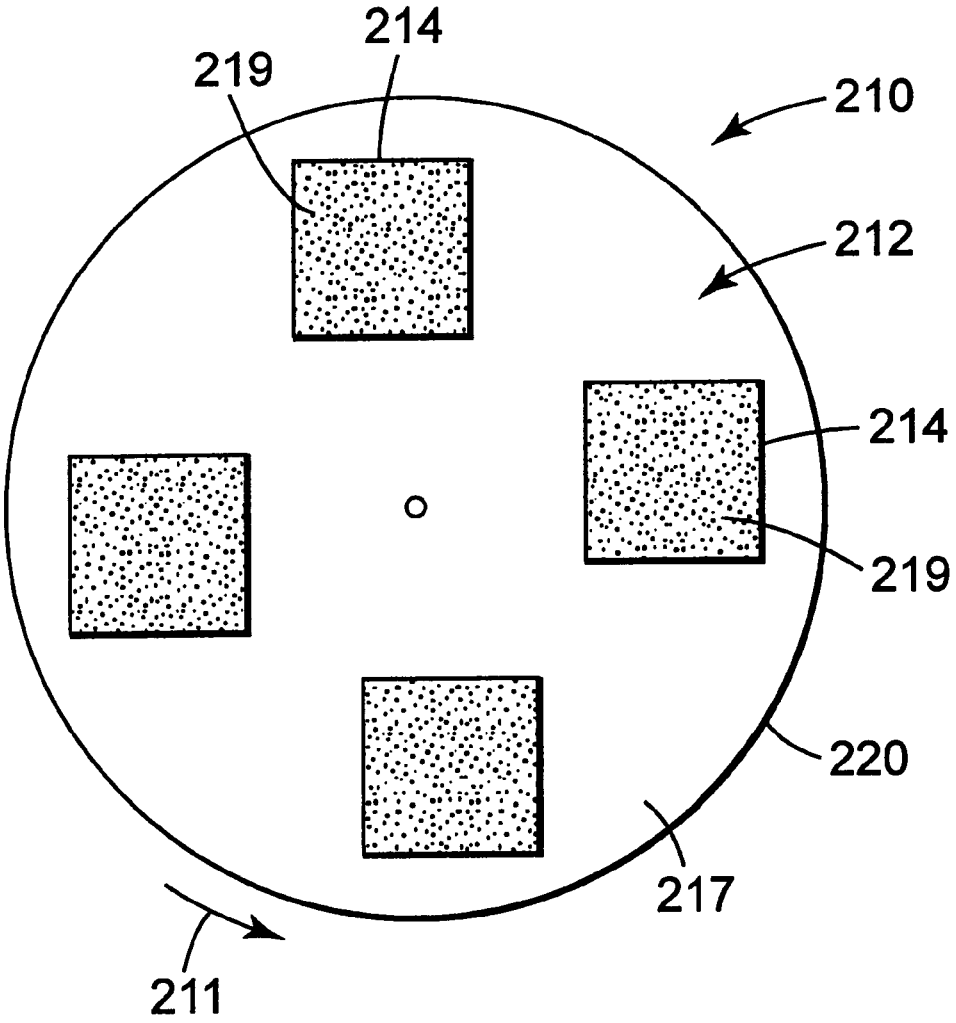
FIG. 17 is a top view of a third embodiment of a grinding tool including a plurality of wedge-shaped abrasive segments in accordance with the present invention.
Figure 18:
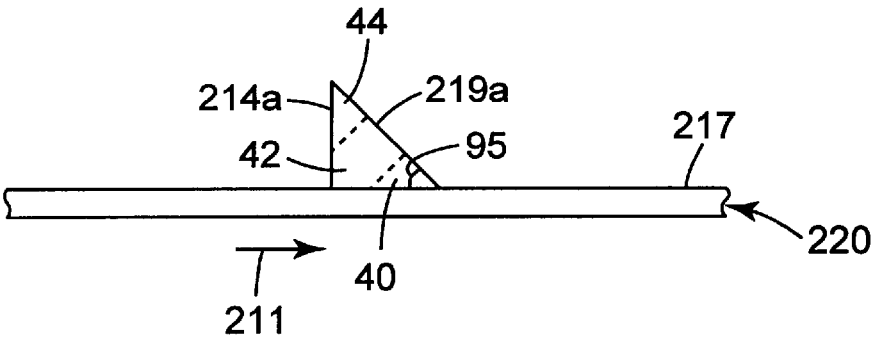
FIG. 18 is a partial side view of the grinding tool shown in FIG. 17.

Tool 210, shown in FIG. 17, includes segments 214 mounted onto one face of a mounting plate in the form of a substrate disc 220. Tool 210 is designed to be rotated about the center of disc 220. Tool 210 has a working region 212 defined by the area swept out by paths of each grinding surface 219 of abrasive segments 214 as tool 210 moves through a single rotation. As shown in FIG. 18, which is a side view of tool 210, segments 214*a* are mounted to disc 220 such that the grinding surface 219*a* of each segment 214*a* is at an angle 95, which is between 0 degrees and 90 degrees, exclusive, with first, substantially planar face 217 of disc 220. That is, elements 214*a* are mounted to disc 220 such that laminated thickness layers 40, 42, and 44 making up elements 214*a* are at an angle of between 0 degrees and 180 degrees, exclusive, to planar surface 217 of disc 220. To grind a workpiece, tool 210 rotates in the direction of arrow 211 such that each surface 219*a* contacts the workpiece. As shown in FIG. 18, segments 214*a* can have a generally right-triangular cross section with the right angle adjacent to disc 220. Additionally, it is contemplated that the right angle of the cross section of the abrasive segments be located away from disc 220, as that of segment 214*b* shown in FIG. 19. Each grinding surface 219*b* of segments 214*b* is at an angle 96 which is between 0 degrees and 90 degrees, exclusive, with face 217 of disc 220. The abrasive segments could also have different cross sections such as the quadrilateral shim-like shape of segment 214*c* shown in FIG. 20, having one surface perpendicular to planar face 217 and a grinding surface 219*c* at an angle 97 to planar face 217. Angle 97 is between 0 degrees and 90 degrees, exclusive. Other shapes of the abrasive segments are also contemplated.

Angling the grinding surfaces 219*a*, 219*b*, and 219*c* with respect to the face 217 of tool 210, which does not include filler material, has the advantage of providing smoother and quieter grinding.

Tool 210 can be fabricated in substantially the same way as tool 10. As shown in phantom in FIG. 21, which is a side view of sheet 36, segments 214*a* and 214*b* can be cut from sheet 36 such that the grinding surfaces 219*a* and 219*b*, respectively, are perpendicular, or at an angle of substantially 90 degrees, to thickness layers 40, 42 and 44. It is also contemplated cut segments 214*a* and 214*b* such that the grinding surfaces 219*a* and 219*b* are at an angle of between 0 degrees and 180 degrees, exclusive, with the plane of thickness layers 40, 42, and 44. Segment 214*c* can be cut from sheet 36 such that the thickness layers 40, 42, and 44 are parallel to the planar face 217 of disc 220 and each grinding surface 219*c* is at an angle 97, which is between 0 degrees and 90 degrees, exclusive, with thickness layers 40, 42, and 44. Forming and mounting segments 214*a*, 214*b*, and 214*c* in this way allows for substantial support for grinding surfaces 219*a*, 219*b*, and 219*c*, respectively while retaining a relatively high concentration of hard particles on grinding surfaces 219*a*, 219*b*, and 219*c*. As such, grinding surfaces 219*a*, 219*b*, and 219*c* need make up only a relatively small portion of a working region 212 of tool 210, generally from about 0.1% to about 60% of the working region 212 and preferably from about 5% to about 50% or the working region 212. Further, this configuration of segments 214 provides for relatively long wheel life because as each surface 219 wears, there is a large amount of segment 214 to replace the worn away surface. After cutting segments 214*a*, 214*b*, or 214*c* from sheet 36, they can be mounted onto the planar face 217 of substrate disc 220 by adhesive, welding, brazing or any other method known in the art.

Figure 19:
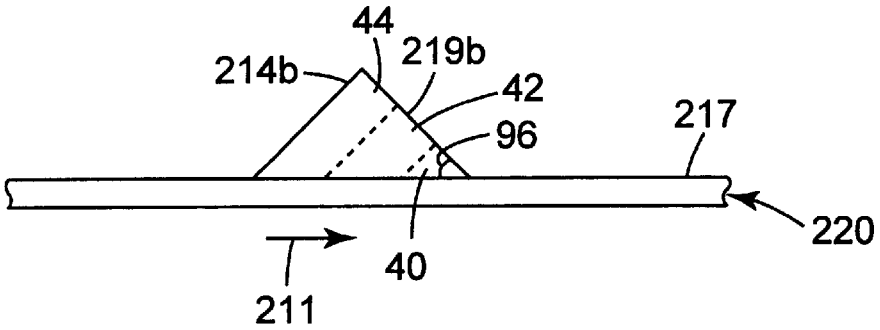
FIG. 19 is a partial side view of a grinding tool similar to that shown in FIG. 17 including a second embodiment of wedge-shaped abrasive segments.
Figure 20:
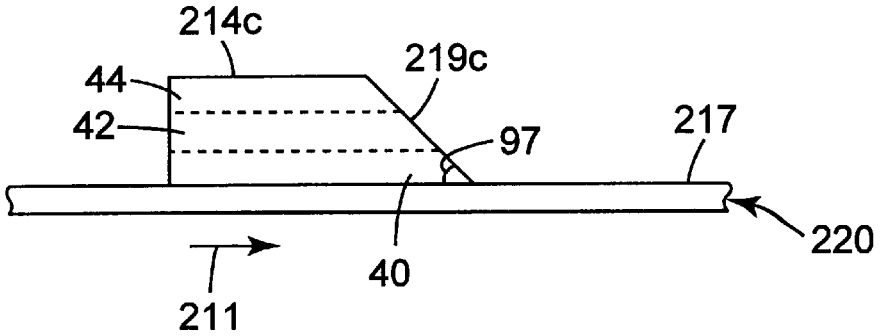
FIG. 20 is a partial side view of a grinding tool similar to that shown in FIG. 17 including a third embodiment of wedge-shaped abrasive segments.

Additionally, as shown in FIGS. 17, 18 and 19, segments 214*a* and 214*b* are mounted onto disc 220 such that the direction of motion 211 of disc 220 is at an angle other than 0 degrees or 180 degrees with thickness layers 40, 42, and 44. As discussed above, mounting segments 214*a* and 214*b* to disc 20 in this way helps avoid the formation of grooves in segments 214*a* and 214*b* in regions of relatively low concentration or no abrasive particles. As such, wear rate can be reduced and useful tool life extended. Further, as shown in FIG. 20, the thickness layers 40, 42 and 44 of segment 214*c* are mounted parallel to the surface 217 of disc 220. Therefore, grooving in regions of no or lower concentration of hard particles will be reduced over a configuration in which the thickness layers 40, 42, and 44 are parallel with the direction of motion of disc 220 and perpendicular to surface 217. Again, reduced grooving can decrease wear rate and increase useful tool life.

Figure 22:
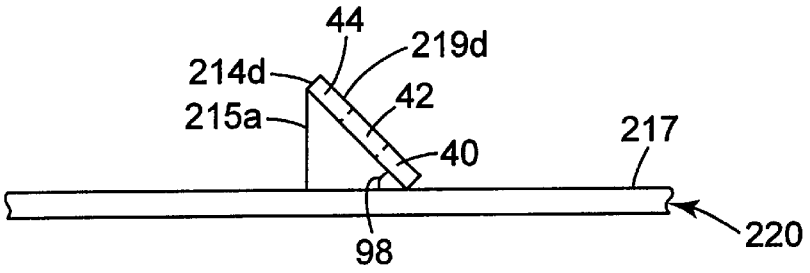
FIG. 22 is a partial side view of a grinding tool similar to that shown in FIG. 17 including an abrasive segment mounted to a rigid support.
Figure 23:
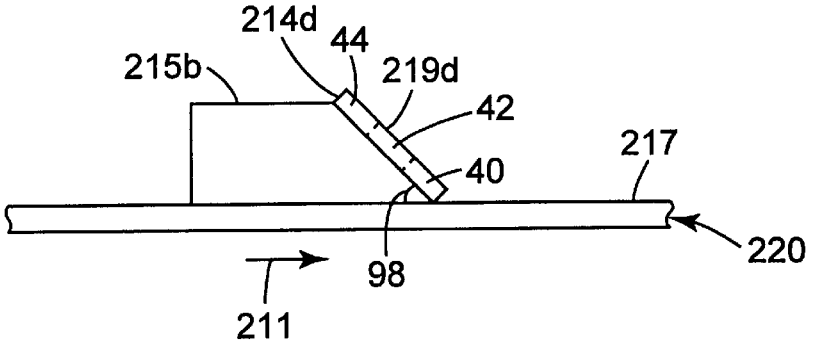
FIG. 23 is a partial side view of a grinding tool similar to that shown in FIG. 17 including another embodiment of rigid support having an abrasive segment mounted thereto.

As shown in FIG. 22, it is also contemplated to form tool 210 having segment 214*d* with grinding surface 219*d* supported by support 215*a* placed adjacent to disc 220 and segment 214*d*. Grinding surface 219*d* is at an angle 98, which is between 0 degrees and 90 degrees, exclusive, with planar face 217 of disc 220. Support 215*a* can be formed of steel, plastic, or other rigid material. It is contemplated to form the support having triangular cross sections, such as support 215*a* shown in FIG. 22, or a wedge shape cross section, such as support 215*b* shown in FIG. 23. Other shapes for the supports are also contemplated. Using supports such as supports 215*a* and 215*b* can reduce the amount of superabrasive material used to fabricate tool 210, thereby reducing the cost of fabrication of tool 210.

Methods of forming rigid supports such as supports 215*a* and 215*b* are well known in the art. As shown in phantom in FIG. 24, segments 214*d* shown in FIGS. 22 and 23 can be cut from sheet 36 such that grinding face 219*d*, which is at an angle to the surface of substrate disc 220, is perpendicular to thickness layers 40, 42, and 44. Segments 214*d* can be cut either with or without legs similar to legs 13 of segments 14 shown in FIG. 8. Segments 214 can be mounted to supports 215*a* or 215*b* by adhesive, brazing, welding or other known methods either before or after segments 219*d* are mounted to disc 220.

Elements 214*a*, 214*b*, and 214*d* are all mounted to disc 220 such that laminated thickness layers 40, 42, and 44 forming elements 214*a*, 214*b*, and 214*d* all form an angle between 0 degrees and 180 degrees, exclusive to surface 217. That is, the thickness layers 40, 42, and 44 of elements 214*a*, 214*b*, and 214*d* are not parallel to surface 217.

Figure 21:
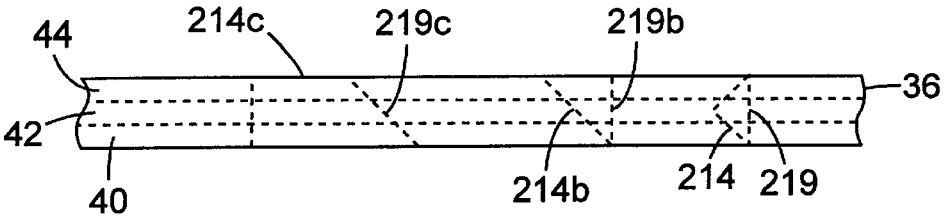
FIG. 21 is a partial side view of the laminated sheet shown in FIG. 4 illustrating, in phantom, a manner for cutting the abrasive segments shown in FIGS. 18, 19 and 20 from the laminated sheet.
Figure 24:
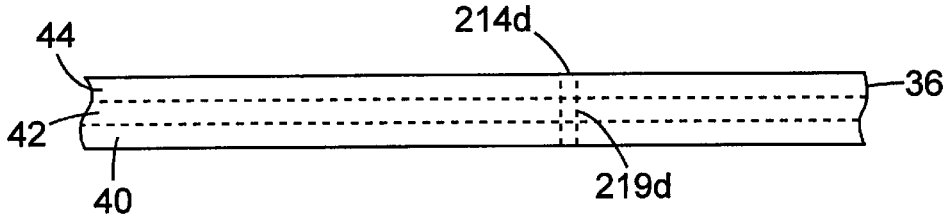
FIG. 24 is a partial side view of the laminated sheet shown in FIG. 4 illustrating, in phantom, a manner of cutting the abrasive segments shown in FIG. 22 and 23 from the laminated sheet.
Figure 25:
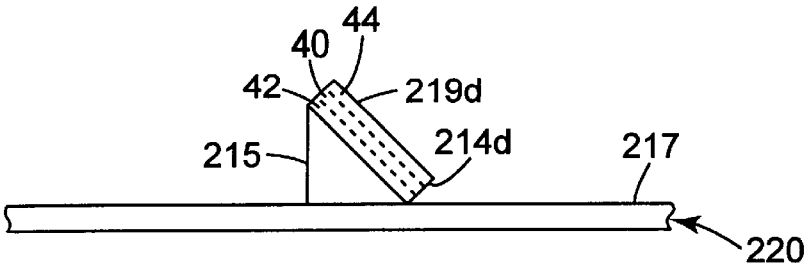
FIG. 25 is a partial side view of a grinding tool similar to that shown in FIG. 17 including a rigid support having another embodiment of an abrasive segment mounted thereto.

If segments 214*a*, 214*b*, or 214*d* are cut as shown in FIGS. 21 or 24, respectively, such that the grinding surface 219 is perpendicular to thickness layers 40, 42, and 44, respectively, the distance that segments 214*a*, 214*b* or 214*d* extend above the surface of disc 220 will be relatively small. This distance can be increased by increasing the number of thickness layers that make up the laminated sheet from which segments 214*a*, 214*b*, and 214*d* are cut. As shown in FIG. 25, this distance can also be increased by cutting abrasive segments 214*d* from sheet 36, and mounting the segments on support 219*d* such that grinding surface 219*d* is parallel to thickness layers 40, 42, and 44. That is, initially, before being worn down by grinding, the exposed portion of grinding surface 219*d* is made up entirely of an outside thickness layer, such as thickness layer 44, of a laminated sheet such as sheet 36.

Sheet 36 can be formed such that the hard particles of an outside hard particle layer (either layer 70 or layer 74) protrudes slightly from the surface of sheet 36. A method for forming sheets similar to sheet 36 in which the hard particles protrude above the surface of the sheet is disclosed in Tselesin, U.S. Pat. No. 5,049,165 for Composite Material, issued Sep. 17, 1991 and reexamination certificate No. B1-5,049,165 issued therefor Sep. 26, 1995, each of which have been incorporated in their entirety. By forming grinding surface 219*d* such that hard particles protrude therefrom, grinding rate can be increased.

Figure 26:
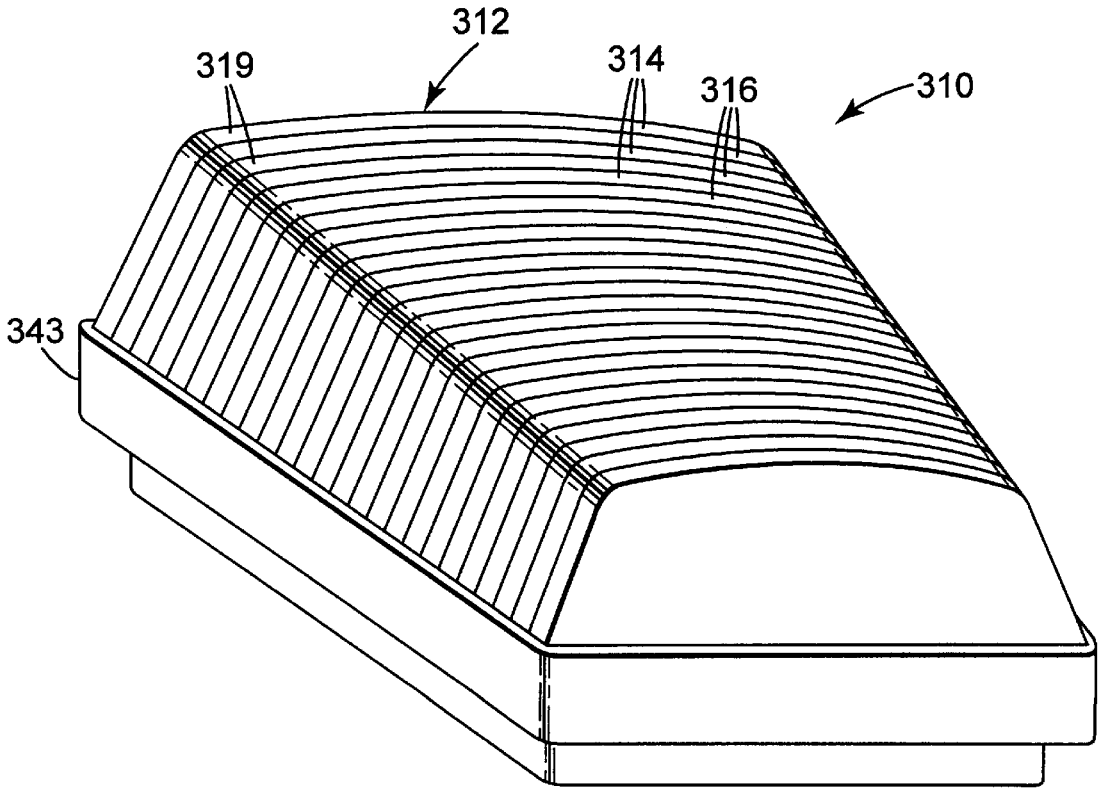
FIG. 26 is a perspective view of another embodiment of a grinding tool having abrasive segments attached to a substantially trapezoidal mounting plate in accordance with the present invention.
Figure 27:
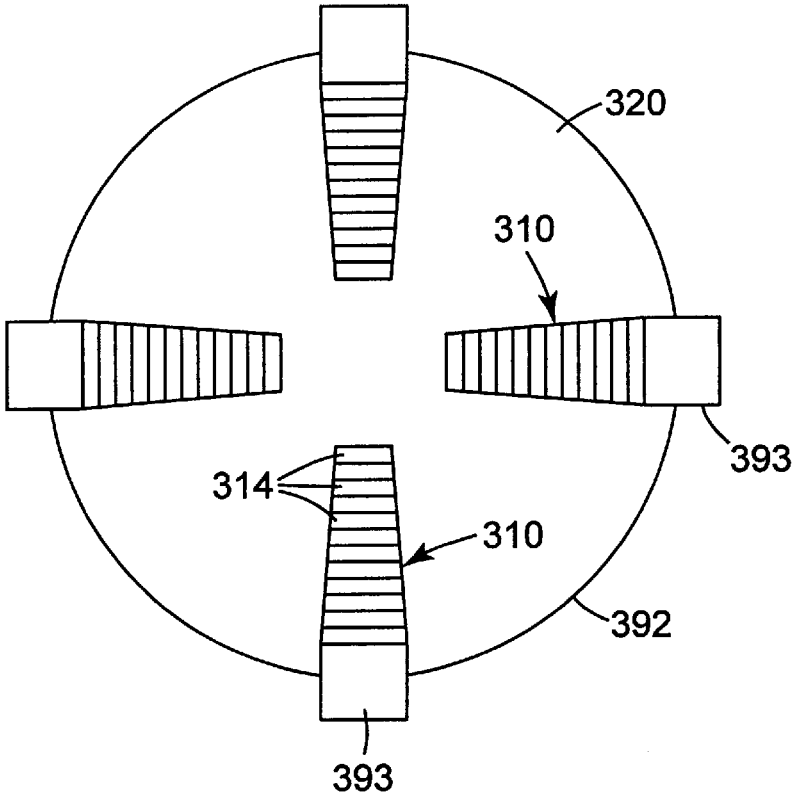
FIG. 27 is a top view of a plurality of grindings tool shown in FIG. 26 mounted on a circular rotatable head.
Figure 28:
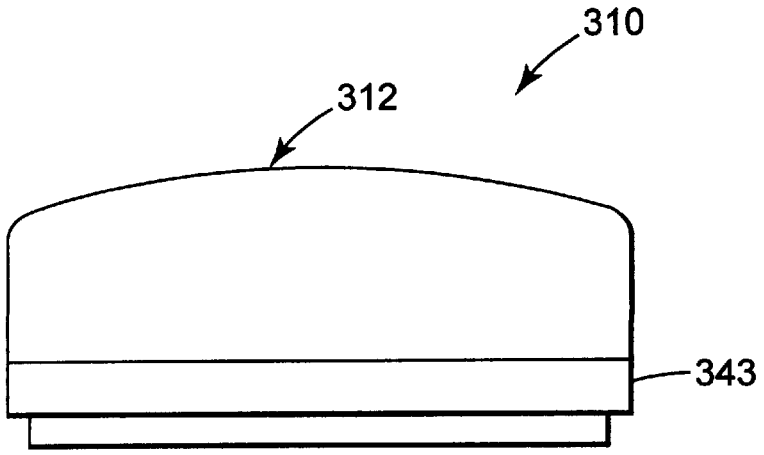
FIG. 28 is an end view of the grinding tool shown in FIG. 26.

Another embodiment of the present invention is shown in FIGS. 26, 27 and 28. Elements in FIGS. 26, 27, and 28 similar to those of FIG. 1 and 2 are labeled with like numerals incremented by 300. FIG. 26 shows a perspective view of an abrasive tool in the form of an abrasive brick 310 including a plurality of abrasive or superabrasive segments 314 surrounded by filter material 316 which retain segments 314 in mounting plate 343. Any number of abrasive segments 314 is contemplated to be used with the present invention, and preferably between 7 and 40 segments 314 are used. As shown in FIGS. 26 and 27, brick 310 is illustrated as having a substantially trapezoidal cross section, although other shapes are contemplated depending on the application. Segments 314 have grinding surfaces 319 which form a portion of working region 312 of brick 310. The area of the working region of brick 310 is defined by the area of the top curved surface of brick 310 which contacts a workpiece during grinding. In the embodiment shown in FIGS. 26 and 27, working region 312 is formed by grinding surfaces 319 and filler material 316 contained therebetween. From about 5% to about 95% and preferably from about 30% to about 80%, of working region 312 can be formed by grinding surfaces 319.

As noted above, brick 310 includes filler material 316 cast between segments 314. In the embodiment shown in FIGS. 26 and 27, the grinding surfaces 319 are substantially aligned with the uppermost surface of filler material 316. However, it is also contemplated to form brick 310 such that grinding surfaces 319 protrude above the uppermost surface of filler material 316 or filler material 316 is entirely absent. Filler material 316 can be made from the same materials as filler material 16.

As shown in FIG. 27, which is a top view of a plurality of bricks 310 mounted to a circular rotating head 392 via mounting arms 393, working surface 312 of brick 310 is substantially trapezoidal. As such, segments 314 are relatively narrow at the narrow end of the trapezoid and wider at the wide end of the trapezoid. As shown in FIG. 28, which is an end view of brick 310, the working region 312, and therefore the grinding surfaces 319 of elements 314, is curved or arced. Further, in the embodiment shown in FIGS. 26, 27 and 28, the curvature of the arcs becomes progressively sharper towards the narrow end of the trapezoidal working region 312.

Figure 30:
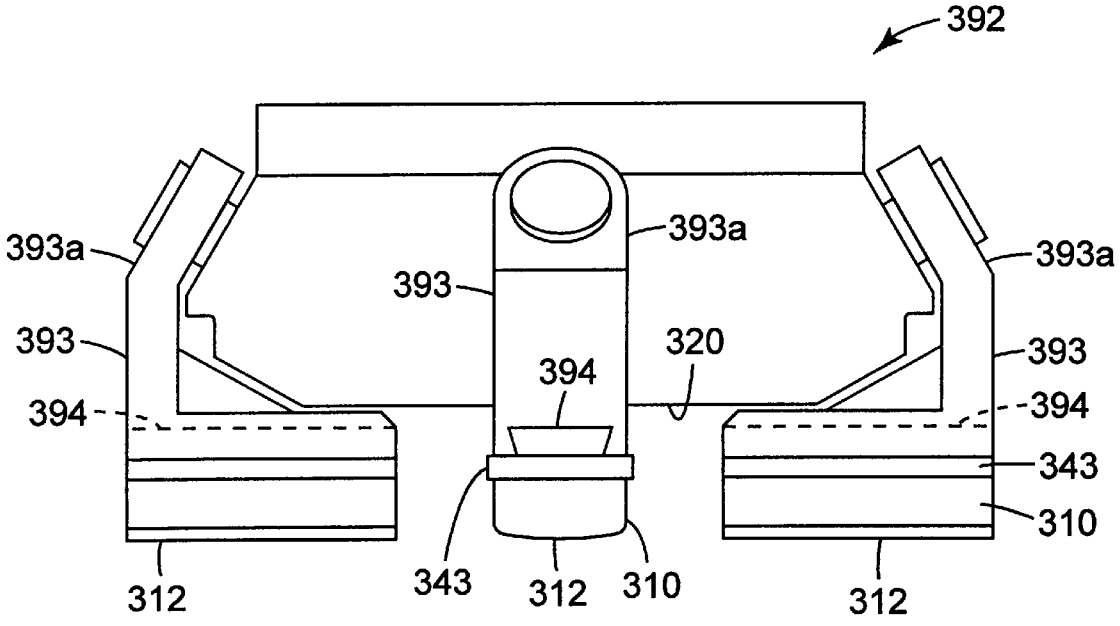
FIG. 30 is a side view of a rotatable head on which the grinding tool shown in FIG. 26 can be mounted.

Working region 312 is curved or arced in this way to facilitate grinding of hard surfaces such as granite and to extend the useful life of brick 310. As shown in FIGS. 27 and 30, brick 310 can be mounted to a circular rotating head 392. Oscillating mounting arms 393 are pivotally attached to rotating head 392 and bricks 310 are coupled to the mounting arms 393. Circular rotating head 392 has a circular surface 320 and rotates about a center point thereof while mounting arms 393 sweep or rock bricks 310 back and forth over the surface of a workpiece (not shown). Accordingly, to expose the entire working region 312 to the workpiece, working region 312 is curved or arced as described above. Grinding a workpiece in this way has at least two advantages. First, by exposing the entirety of working region 312 to the workpiece, and thus using the entire working region to grind the workpiece, the useful life of brick 310 can be increased.

Second, to grind hard surfaces such as granite, relatively high contact pressure is desirable between the grinding tool working region and the workpiece to increase the grinding rate. Further, the smaller the contact area between the working region and the workpiece at any given moment, the greater the contact pressure therebetween for a given contact force. By curving or arcing the working region, only a relatively narrow strip of the working region is in contact with the workpiece at any given time. Accordingly, the contact pressure, and thus the grinding rate, is increased.

As noted above, the curvature of segments 314, and working region 312, becomes tighter towards the narrow end of trapezoidal working region 312. This is because the pivot portion 393*a* of mounting arms 393 is at an angle to a plane perpendicular to circular surface 320 of rotating head 392. Accordingly, the narrow end of trapezoidal working region 312 sweeps or rocks over a smaller distance on a workpiece than the wide end of working region in one oscillation of a mounting arm 393. Therefore, the curvature at the narrow end of working region 312 must be sharper to accommodate the smaller distance covered and still use the entire grinding surface. It should be noted that it is also within the ambit of the present invention to form brick 310 having a constant curvature working region along the length of brick 310 perpendicular to the planes of the planar segments 314. This would accommodate a grinding machine having a rotating head with mounting arms which pivot in a plane perpendicular to the mounting surface of the rotating head. It is also contemplated to form brick 310 to have a varying curvature to accommodate a rotating head having mounting arms which pivot at an angle other than that of mounting arms 393 to a plane perpendicular to surface 320.

It is also contemplated to form working region 312 of brick 310 substantially planar, that is without any curvature. This can be done to accommodate a grinding machine in which bricks 312 are not swept or rocked over the surface of the workpiece.

As with segments 14, segments 314 have a relatively high concentration of abrasive particles at working surfaces 319 thereof. Generally from 20 to 1,000,000 particles per linear centimeter, and preferably 400–1,000 per linear centimeter, depending on the number of layers and the particle size.

Figure 29:
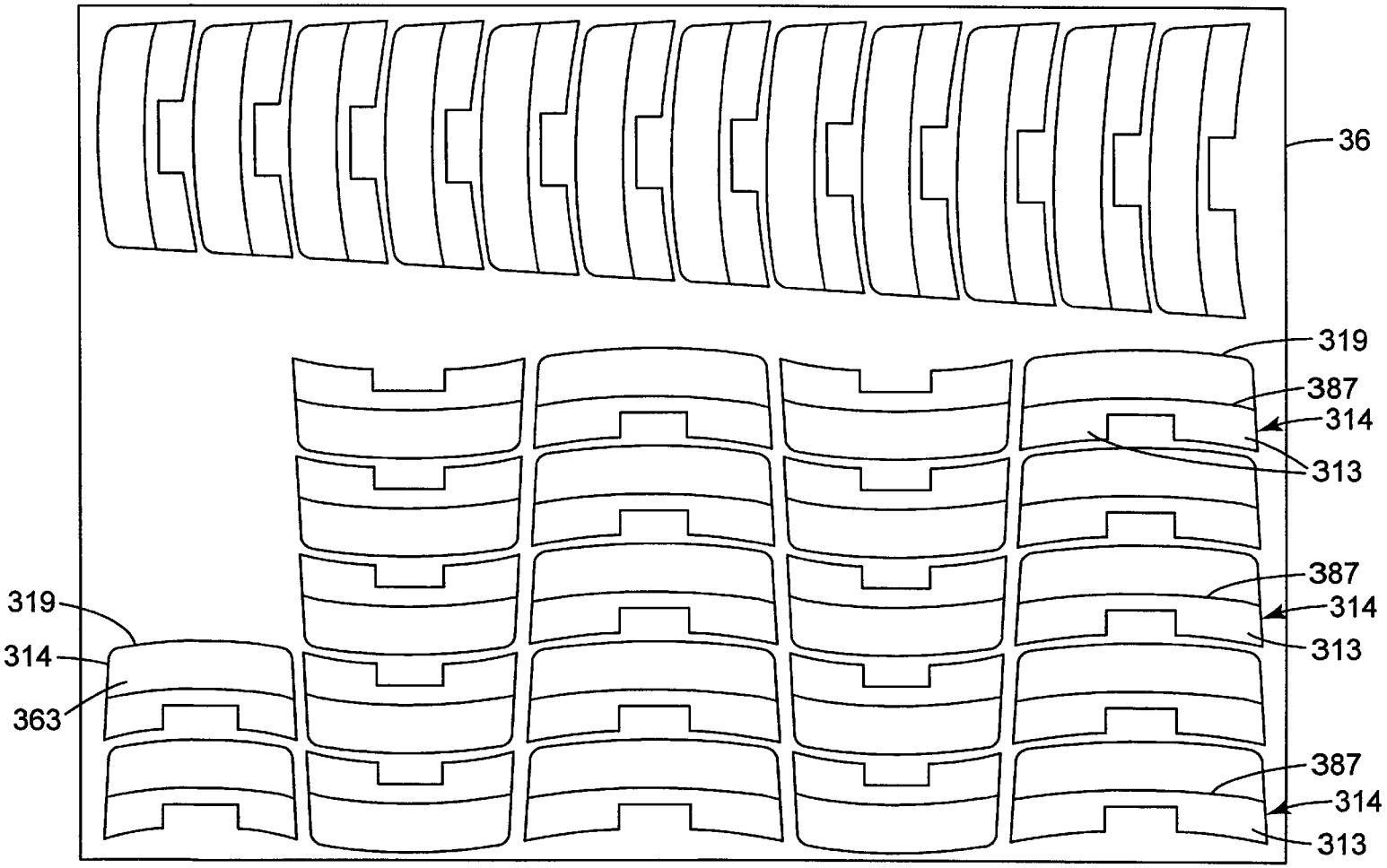
FIG. 29 is a top view of the laminated sheet shown in FIG. 4 illustrating a manner for cutting the abrasive segments of the grinding tool shown in FIG. 26 from the laminated sheet.
Figure 32:
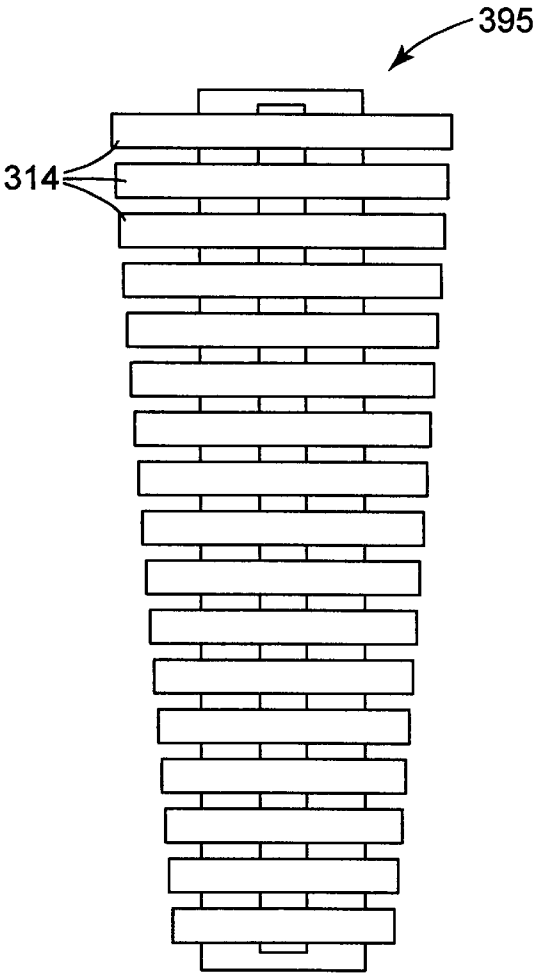
FIG. 32 is a top view of the support frame shown in FIG. 31 including a plurality of abrasive elements suitable for use in the grinding tool shown in FIG. 26.
Figure 31:
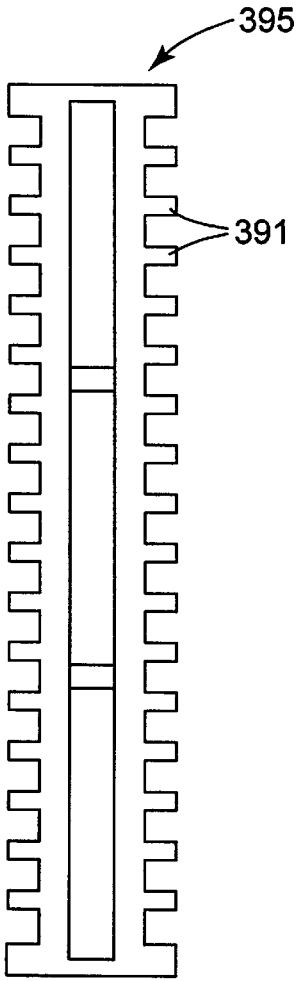
FIG. 31 is a top view of a support frame on which abrasive elements can be arranged for fabrication of the grinding tool shown in FIG. 26.

A method of fabrication of brick 310 can be explained with reference to FIGS. 29, 31 and 32. Segments 314 are cut from sheet 36 by a laser, water jet, EDM, plasma electronbeam, scissors, blades, dies, or other known method as shown in FIG. 29, which is top view of sheet 36. By cutting segments 314 from sheet 36 in this way, the curvatures of grinding surfaces 319 can be precisely controlled and varied depending upon the grinding machine with which a particular brick 310 will eventually be used. This allows bricks 310 to be economically formed for use with different grinding machines and, as such, substantially reduces the amount of dressing of bricks 310 required after mounting on a particular grinding machine.

After segments 314 are cut, they are stood on end when mounted to mounting plate 343 so that thickness layers 40, 42, and 44 forming sheet 36 are perpendicular to grinding surface 319 and working region 312. It is also contemplated, however, that thickness layers 40, 42, and 44 can form angles of other than 90 degrees with working region 312. In this way, a face 363 of each abrasive segment 314 defined by a general plane of one of the thickness layers 40, 42, and 44, will form an angle of between 0 degrees and 180 degrees, exclusive, with the circular surface 320 of rotating head 392 when brick 310 is attached thereto. Further, the working region 312 of brick 310 forms an angle of between 0 degrees and 180, exclusive, with face 363, or, equivalently, thickness layers 40, 42, and 44. As shown in FIG. 29, segments 314 have support feet 313, similar to feet 13, for supporting segments 314 when forming brick 310. To reduce the cost of fabricating brick 310, feet 313 of segments 314 do not need to contain hard particles. The transverse lines 387 above feet 313 of FIG. 29, drawn substantially parallel to the grinding surfaces 319 of segments 314, show the region of each segment 314 having hard particles and the region which does not. The region of each segment 314 having hard particles is between grinding surface 319 and line 387. The remainder of each segment 314 does not have hard particles.

Figure 33:
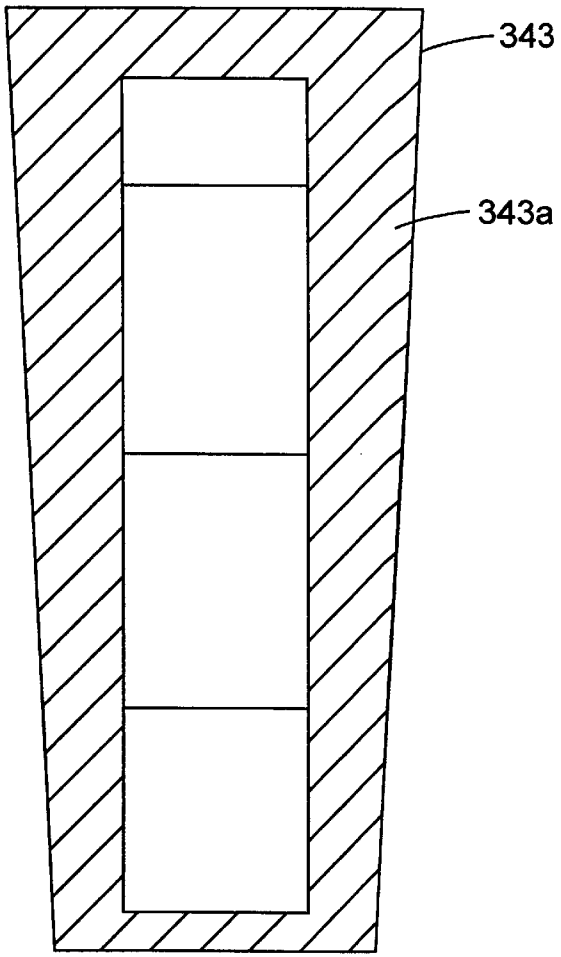
FIG. 33 is a top view of a mounting plate on which abrasive elements can be mounted to form the grinding tool shown in FIG. 26.

Segments 314 are connected to mounting plate 343 via filler material 316. Segments 314 are placed parallel to one another in an assembly plate 395, as shown in FIGS. 31 and 32. Assembly plate 395 includes support bars 391 for supporting feet 313 of segments 314 therebetween. Assembly plate 395 containing segments 314 and mounting plate 343 are then set into a mold (not shown) having the shape of brick 310. As shown in the shaded region of FIG. 33, mounting plate 343 includes a planar lip surface 343*a*. Preferably, assembly plate 395, segments 314 and mounting plate 343 are placed into the mold such that faces of segments 314 defined by planes parallel to thickness layers 40, 42, and 44, which form segments 314, are substantially perpendicular to planar lip surface 343*a*. However, it is contemplated that faces of segments 314 defined by the planes of thickness layers 40, 42, and 44 which form segments 314, can form any angle between 0 degrees and 180 degrees, exclusive, with planar lip surface 343*a*. Filler material 316 is then poured into the mold an allowed to cure. It is filler material 316 that attach segments 314 to mounting plate 343. After curing, brick 310 is removed from the mold. Assembly plate 395 and support plate 343 can be formed of any rigid material and are preferably formed of plastic. Assembly plate 395 and support plate 343 can be formed by injection molding or any other known methods.

As noted above, and as shown in FIGS. 27 and 30, a plurality of bricks 310 can be mounted to a rotating head 392 which generates orbital motion of the plurality of bricks 310 about the center of circular surface 320 while rocking each brick 310. Each brick 310 can be attached to each mounting arm 393 by a tapered base of mounting plate 343 which closely interfits with tapered slot 394 of mounting arm 393. Other known methods of attaching brick 310 to mounting arm 393 are also considered. Rotating head 392 can be mounted to a motorized X-Y travel gantry (not shown). In this way, bricks 310 can be simultaneously rotated and translated in an X-Y plane in pressurized contact with the planar surface of a workpiece which can either be held stationary or also moved in the X-Y plane beneath the rotating and rocking bricks 310. Machines having a rotating head such as head 392 movable in an X-Y plane to which a plurality of bricks 310 can be mounted are manufactured by and available from Breton S.P.A., of Castello Di Godego, Treviso, Italy; Simec S.P.A. of Castello Di Godego, Treviso, Italy; and Thibaut S.A., Vire, France. The Thibaut machine is available through Precision Stonecraft of Atlanta, Ga., U.S.A. In particular, the Thibaut T502 machine has been used with bricks 310 to grind various types of stone such as granite and marble.

EXAMPLES

The following general procedure was used to prepare the diamond segments used in the segmented grinding disc of the present invention.

An open mesh screen having openings approximately 0.6 mm per side and 0.17 mm diameter stainless wire, was cut to 12.7 cm by 12.7 cm (5 inches by 5 inches). A pressure sensitive adhesive commercially available from Minnesota Mining and Manufacturing Company (St. Paul, Minn.) under the trade designation "SCOTCH" brand adhesive tape was placed on one side of the screen. Diamond abrasive particles of approximately 0.42 mm diameter were dropped onto the screen openings so that the diamonds adhered to the tape. This resulted in diamond particles occupying the majority of the screen openings.

Six hundred (600) parts of a powder bond mixture containing 71.5% Co, 22.5% Cu, 2.5% Sn, 3.01% Ni, 0.28% Cr and 0.2% P were mixed with 67 parts 1.5:1 methylethylketone:toluene, 6 parts polyvinyl butyral, 2.26 parts polyethylene glycol having a molecular weight of about 200, and 3.74 parts dioctylphthalate. This mixture was knife coated onto a release liner to provide a 161 $cm^2$ (25 $in^2$) flexible sheet of metal powder approximately 5.6 mm (22 mils) thick having a weight approximately 0.15 grams/$cm^2$ (0.98 grams/$in^2$).

The screens, filled with abrasive particles, and flexible sheets of metal powder were stacked upon each other to form a laminar composite. The specific layering sequence is detailed in each Example. The layered construction was placed between graphite slabs and placed in a frame. The layered construction was heated to 1000° C. under a pressure of approximately 200 kg/$cm^2$, then held at approximately 1000° C. under a pressure of approximately 400 kg/$cm^2$ for about 4 minutes, and then cooled to ambient temperature under pressure.

The construction was then cut into segments with a laser, and then the segments were spaced on the surface of a 10 cm (4 inch) diameter substrate disc. There were 10 segments of approximately 32 mm×5 mm×2 mm, and each segment had two small feet which extended from the long side of the segment and were used to space, align and secure the segment to the substrate disc before brazing. These segments were brazed to the substrate disc in a counterclockwise arrangement similar to what is shown in FIG. 1.

An epoxy resin, made up of 48% "Epon 828" (from Shell Chemical Co., Houston Tex.), 20% "Jeffamine D230" (from Huntsman Corp., Conroe Tex.), 30% "Peerless #4" clay (from R.T. Vanderbilt Co. Inc., Bethel Conn.) and 2% red iron oxide, was cast around the segments.

Five troughs were carved into the surface of the cured epoxy surface. Each trough was approximately 4 mm deep, and extended a length of about 5 cm from the periphery of the disc to the center. At the center, each trough extended into holes that emerged through on the backside of the disc.

The disc was mounted on a center waterfeed grinder and used to grind a radius onto the edge of a stone workpiece at 3200 RPM.

Example 1 was prepared as described in the general procedure. The resulting segment consisted of the following layers:

0.124 grams/$cm^2$ metal bond layer
diamonds/screen layer
0.28 grams/$cm^2$ metal bond layer
diamonds/screen layer
0.28 grams/$cm^2$ metal bond layer
diamonds/screen layer
0.28 grams/$cm^2$ metal bond layer
diamonds/screen layer
0.124 grams/$cm^2$ metal bond layer Example 2 was prepared as described in Example 1 except that the metal bond layers of 0.28 grams/$cm^2$ were replaced with metal bond layers of 0.56 grams/cm$^2$. Testing showed that Example 1 cut 25% faster and wore 20% slower than Example 2.

Example 3 was prepared as described in Example 1 except that the segments were bonded to the substrate disc in a clockwise arrangement. Example 3, having the clockwise arrangement of segments, produced a greater chipping on the edge of the stone workpiece.

Example 4 was prepared as described in Example 1 except that 5 additional short segments (16 mm long vs. 32 mm for all other segments) were bonded. The resulting disc is shown in FIG. 1. Example 4 ran quieter and wore 10% slower than Example 1.

Example 5 was prepared as described in Example 1 except that 15 segments, rather than 10 segments, were used. Example 5 produced a superior surface finish, ran quieter and wore 30% slower than Example 1, and there was no significant change in cut rate.

Example 6 was prepared as described in Example 1 except that 20 long segments were used. Example 6 had similar noise, surface finish and wear to Example 5, but at a 20% lower cut rate.

Though the present invention has been described with reference to preferred embodiments, those skilled in the art will recognize that changes can be made in form and detail without departing from the spirit and scope of the invention.

What is claimed is:

1. A tool for connection to a tool driver for moving the tool in a rotary motion, the tool comprising:

a mounting plate having a first surface; and a plurality of abrasive segments attached to the first surface of the mounting plate, at least one abrasive segment made up of a plurality of substantially parallel layers of abrasive particles in a sintered bond material and having a segment face defined by a general plane of one of the layers wherein the segment face forms an angle between 0 and 180 degrees, exclusive with the first surface of the mounting plate.

2. The tool of claim 1:

wherein each abrasive segment includes a grinding surface having a concentration of hard particles therein; and including a working region defined by the area that will be swept out by paths of each grinding surface of the plurality of abrasive segments as the tool is moved through a single rotation of its rotary notion when attached to the tool driver wherein the cumulative area of the grinding surfaces takes up between 5% and 50% of the area of the working region.

3. The tool of claim 1 wherein the mounting plate is a substantially circular disc.

4. The tool of claim 3 wherein the plurality of abrasive segments is located entirely within a perimeter of the first surface of the circular disc.

5. The tool of claim 4 wherein the grinding surface of at least one of the abrasive segments is parallel to and raised above the first surface of the circular disc.

6. The tool of claim 1 wherein filler material is formed around at least one of the plurality of abrasive segments on the mounting plate.

7. The tool of claim 6 including a plurality of channels formed in the filler material.

8. The tool of claim 7 wherein the channels include troughs having at least one open surface.

9. The tool of claim 1 wherein at least one of the plurality of abrasive segments is generally rectangular in shape.

10. The tool of claim 1 wherein the tool driver moves the mounting plate in a direction of travel and at least one of the segments is attached to the mounting plate such that the segment contacts a work object at a point where the direction of travel is at an angle of between 0 degrees and 180 degrees, exclusive, with the segment face.

11. The tool of claim 1 wherein at least one abrasive segment includes a grinding surface which acts to primarily grind a work object and the concentration of hard particles at the grinding surface of the abrasive segment is substantially homogeneous in at least one direction.

12. The tool of claim 1 wherein at least one of the segments includes a grinding surface which acts to primarily grind a work object, the grinding surface including a varying concentration of hard particles therein.

13. The tool of claim 1 wherein at least one of the segment includes a grinding surface which acts to primarily grind a work object and the grinding surface of the abrasive segment is formed at an angle between 0 and 180 degrees, exclusive, with the segment face.

14. A tool for connection to a tool driver, the tool comprising:

a mounting plate having a first surface and moved by the tool driver in a direction of travel;

a plurality of abrasive segments attached to the first surface of the mounting plate, each abrasive segment made up of a plurality of substantially parallel layers of abrasive particles in a sintered bond material and having a segment face defined by a general plane of one of the layers;

wherein at least one segment contacts a work object at a point where the direction of travel is at an angle between 0 degrees and 180 degrees, exclusive, with the segment face.

15. The tool of claim 14 wherein each abrasive segment further includes a grinding surface which acts to primarily grind a workpiece.

16. The tool of claim 15 wherein at least one grinding surface is formed at an angle of between 0 degrees and 180 degrees, exclusive, with the element face.

17. The tool of claim 15 wherein the concentration of hard particles at the grinding surface of at least one abrasive segment is between 400 and 1,000,000 hard particles per square centimeter.

18. The tool of claim 15 wherein the mounting plate is a substantially circular disc.

19. The tool of claim 18 wherein the grinding surface of at least one abrasive segment is parallel to and raised above a first face of the circular disc.

20. The tool of claim 19 wherein filler material is formed around at least one of the plurality of abrasive segments on the circular disc and at a substantially same height above the circular disc to which the grinding surface of the abrasive segment is raised.

21. The tool of claim 15 wherein the grinding surface of at least one abrasive segment is substantially perpendicular to the first surface of the mounting plate.

22. The tool of claim 15 wherein the grinding surface of at least one abrasive segment is substantially parallel to the segment face.

23. The tool of claim 14 wherein the plurality of abrasive segments are generally rectangular in shape.

24. The tool of claim 14 including a plurality of curved channels formed in the filler material.

25. The tool of claim 24 wherein the channels include troughs having at least one open surface.

26. The tool of claim 14 wherein the segment face is formed at an angle of between 0 degrees and 180 degrees, exclusive, with the first surface of the mounting plate.

27. A tool for connection to a tool driver, the tool comprising:

a mounting plate having a first surface;

a plurality of abrasive segments attached to the first surface of the mounting plate, at least one abrasive segment is made up of a plurality of layers of abrasive particles in a sintered bond material and having an element face defined by a general plane of one of the layers, each abrasive segment further including a grinding surface wherein the grinding surface is formed at an angle between 0 and 180 degrees, exclusive, with the element face; and a working region defined by a surface of the tool which comes into contact with a workpiece during a grinding operation when attached to the tool driver, the working region including a first end, a second end, and a curvature varies from the first end to the second end;

wherein the cumulative area of the grinding surface takes up between 5% and 95% of the area of the working region.

28. The tool of claim 27 wherein the grinding surface takes up between 30% and 80% of the area of the working region.

* * * * *

UNITED STATES PATENT AND TRADEMARK OFFICE

CERTIFICATE OF CORRECTION

PATENT NO. : 6,196,911 B1
DATED : March 6, 2001
INVENTOR(S) : Preston, Jay B.

It is certified that error appears in the above-identified patent and that said Letters Patent is hereby corrected as shown below:

Column 12,
Line 62, “bum” should be -- burn --.

Column 21,
Line 45, “notion” should be -- motion --.

Signed and Sealed this

Twenty-eighth Day of October, 2003

JAMES E. ROGAN
*Director of the United States Patent and Trademark Office*